US009254671B2

(12) United States Patent
Okazaki et al.

(10) Patent No.: US 9,254,671 B2
(45) Date of Patent: Feb. 9, 2016

(54) LIQUID SUPPLYING DEVICE AND LIQUID CARTRIDGE MOUNTABLE THEREIN

(71) Applicant: Brother Kogyo Kabushiki Kaisha, Nagoya-shi, Aichi-ken (JP)

(72) Inventors: Naoya Okazaki, Hashima-gun (JP); Tetsuro Kobayashi, Nagoya (JP); Tomohiro Kanbe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/616,075

(22) Filed: Feb. 6, 2015

(65) Prior Publication Data

US 2015/0224779 A1 Aug. 13, 2015

(30) Foreign Application Priority Data

Feb. 10, 2014 (JP) ..... 2014-023759

(51) Int. Cl.
*B41J 2/175* (2006.01)

(52) U.S. Cl.
CPC ..... *B41J 2/1752* (2013.01); *B41J 2/17513* (2013.01); *B41J 2/17596* (2013.01)

(58) Field of Classification Search
CPC ..... B41J 2/17503–2/17556; B41J 2/175; B41J 2/17596
See application file for complete search history.

(56) References Cited

U.S. PATENT DOCUMENTS

| | | | | |
|---|---|---|---|---|
| 5,425,478 | A * | 6/1995 | Kotaki | B41J 2/17523 222/501 |
| 5,606,988 | A | 3/1997 | Pawlowski, Jr. | |
| 8,419,173 | B2 | 4/2013 | Hayashi et al. | |
| 2003/0071874 | A1 | 4/2003 | Ishizawa et al. | |
| 2005/0088497 | A1 * | 4/2005 | Katayama | B41J 2/17509 347/86 |

FOREIGN PATENT DOCUMENTS

| | | | |
|---|---|---|---|
| JP | 2941189 | B2 | 8/1999 |
| JP | 2002-079683 | A | 3/2002 |
| JP | 4506301 | B2 | 7/2010 |

OTHER PUBLICATIONS

Co-Pending U.S. Appl. No. 14/616,045, filed Feb. 6, 2015.
Sep. 24, 2015—(US)—Non-Final Office Action—U.S. Appl. No. 14/616,045.

* cited by examiner

*Primary Examiner* — Geoffrey Mruk
(74) *Attorney, Agent, or Firm* — Banner & Witcoff, Ltd.

(57) ABSTRACT

A liquid supplying device includes a liquid cartridge and a cartridge mounting unit having a liquid extraction tube. The liquid cartridge includes a liquid chamber, a valve chamber extending in a first direction away from the liquid chamber, first and second air channels, a seal member having a through-hole, a valve element having a closing part, first and second sealing parts and a liquid channel. A third sealing part is provided on the closing part or the liquid extraction tube. The liquid extraction tube entering into the valve chamber through the through-hole contacts the closing part, moving the valve element in a second direction opposite to the first direction from a first state where the closing part closes the through-hole, to a second state where the third sealing part closes the through-hole, and to a third state where the valve chamber is communicated with inside of the liquid extraction tube.

9 Claims, 14 Drawing Sheets

LIQUID SUPPLYING DEVICE AND LIQUID CARTRIDGE MOUNTABLE THEREIN

CROSS REFERENCE TO RELATED APPLICATION

This application claims priority from Japanese Patent Application No. 2014-023759 filed Feb. 10, 2014. The entire content of the priority application is incorporated herein by reference.

TECHNICAL FIELD

The present invention relates to a liquid cartridge that supplies liquid stored therein, and a liquid-supplying device provided with the liquid cartridge.

BACKGROUND

An inkjet recording device well known in the art records images on paper by ejecting ink stored in an ink cartridge onto the paper through nozzles formed in a recording head. When ink in the ink cartridge is consumed through image-recording processes performed by the inkjet recording device, the empty ink cartridge is removed and replaced with a new ink cartridge filled with ink.

The conventional ink cartridge has an ink supply unit for supplying ink, and an air communication unit that provides communication between a layer of air in an ink chamber that stores ink and the exterior of the device. The air communication unit is closed when the ink cartridge is stored so that the ink chamber is kept enclosed. When the ink cartridge is mounted in the inkjet recording device, the air communication unit is opened so that the ink chamber can be in communication with ambient air.

The air communication unit is preferably opened to the external air prior to the ink supply unit when the ink cartridge is mounted in the inkjet recording device. If the ink supply unit were opened before the air communication unit while the ink chamber is in a sub-atmospheric pressure state, ink may flow from the recording head connected to the ink supply unit to the low-pressure ink chamber. This action could break the meniscus of ink in nozzles of the recording head. Even if the pressure in the ink chamber has not been reduced to below atmospheric pressure, an excessive amount of ink may be supplied from the ink chamber to the recording head when in high-altitude regions or areas having an atmospheric pressure lower than the internal pressure of the ink chamber. Such a phenomenon can also break the meniscus of ink formed in nozzles of the recording head.

One example of an ink cartridge mounted in an inkjet recording device includes a single valve mechanism for opening and closing both an ink channel and an air channel (see Japanese Patent Publication No. 4506301, for example). With this ink cartridge, an ink delivery tube inserted into a through-hole formed in a tubular member moves the tubular member through a frictional force generated between the two to open the air channel. Subsequently, the ink delivery tube moves a valve element against an urging force of a coil spring to open the ink channel.

SUMMARY

However, the conventional ink cartridge described above requires that the frictional force generated between the tubular member and a wall surface defining a large diameter hole and the frictional force generated between the ink delivery tube and the tubular member be set such that the force required for the ink delivery tube to move through the through-hole while sliding against the tubular member is greater than the force required for the tubular member to move through the large-diameter hole while sliding against the wall surface defining the large-diameter hole so that the ink delivery tube does not move through the through-hole and move the valve element without moving the tubular member. Further, after moving the tubular member, the ink delivery tube moves the valve element while sliding against the tubular member. This requires a relatively large force and, hence, requires a large force for mounting the ink cartridge in the inkjet recording device. Further, since the tubular member and valve element are separate members that move independently, this configuration increases the number of parts constituting the ink cartridge, making it difficult to produce a compact ink cartridge.

In view of the foregoing, it is an object of the present invention to provide a liquid cartridge and a liquid supplying device having simple structures capable of reducing the force required to mount the liquid cartridge while ensuring that communication is reliably established between the interior of the cartridge and ambient air before the liquid supplying device is in a state capable of supplying liquid.

In order to attain the above and other objects, there is provided a liquid supplying device that may include a liquid cartridge and a cartridge mounting unit configured to detachably accommodate the liquid cartridge therein. The cartridge mounting unit may include a liquid extraction tube configured to be inserted into the liquid cartridge during mounting and in a mounted state of the liquid cartridge in the cartridge mounting unit, the liquid extraction tube defining an internal space therein and including a communication hole configured to allow communication between the internal space and outside of the liquid extraction tube. The liquid cartridge may include: a liquid chamber configured to store liquid therein; a valve chamber extending in a first direction away from the liquid chamber; a first air channel; a second air channel; a seal member; a valve element; a first sealing part; a second sealing part; and a liquid channel. The valve chamber is defined by a wall surface including a side wall surface and a proximal wall surface, the side wall surface extending in the first direction and having an annular shaped cross-section taken along a plane orthogonal to the first direction, the side wall surface having a first end and a second end positioned downstream of the first end in the first direction, the proximal wall surface provided on the first end of the side wall surface, the wall surface being formed with a first opening and a second opening, at least one of the first opening and the second opening being formed in the side wall surface. The first air channel is configured to allow air to flow between the valve chamber and ambient air through the first opening. The second air channel is configured to allow air to flow between the liquid chamber and the valve chamber through the second opening. The seal member is provided on the second end of the side wall surface, the seal member being formed with a through-hole for allowing the liquid extraction tube to penetrate therethrough in a second direction opposite to the first direction, the through-hole being defined by a peripheral surface. The valve element is disposed within the valve chamber and has an outer surface, the valve element including a closing part configured to contact the seal member to close the through-hole, at least one of the closing part of the valve element and the liquid extraction tube being provided with a third sealing part configured to make close contact with the peripheral surface of the through-hole and slide relative to the peripheral surface. The first sealing part has an annular shape and is provided on the outer surface of the valve element, the first sealing part being in close contact with the side wall surface and configured to move in the second direction. The second sealing part has an annular shape and is provided on the outer surface of the valve element at a position toward the second end of the side wall surface from the first sealing part, the second sealing part being in close contact with the side wall surface and configured to move in the second direction, the first sealing part and the second sealing part defining an enclosed space therebetween in the valve chamber. The liquid channel is configured to allow liquid to flow between the liquid chamber and a portion of the valve chamber toward the second end of the side wall surface from the second sealing part. The liquid extraction tube is configured to enter into the valve chamber through the through-hole of the seal member in the second direction and contact the closing part to move the valve element in the second direction from a first state to a second state and then to a third state, the third sealing part being positioned downstream of the communication hole of the liquid extraction tube inserted into the valve chamber in the second direction. In the first state, the closing part closes the through-hole of the seal member, the first sealing part interrupting air flow between the first opening and the second opening and the second sealing part being positioned toward the second end of the side wall surface from the first opening and the second opening. In the second state, the liquid extraction tube penetrates through the through-hole and contacts the closing part to move the closing part in the second direction away from the through-hole, the third sealing part making close contact with the peripheral surface of the through-hole to seal the communication hole, air being allowed to flow between the first opening and the second opening through the enclosed space. In the third state, the third sealing part is separated from the peripheral surface of the through-hole, the communication hole of the liquid extraction tube entering into the valve chamber to establish communication between the valve chamber and the internal space of the liquid extraction tube.

According to another aspect of the present invention, there is provided a liquid cartridge that may include: a liquid chamber configured to store liquid therein; a valve chamber extending in a first direction away from the liquid chamber; a first air channel; a second air channel; a seal member; a valve element; a first sealing part; a second sealing part; a third sealing part; and a liquid channel. The valve chamber is defined by a wall surface including a side wall surface and a proximal wall surface, the side wall surface extending in the first direction and having an annular shaped cross-section taken along a plane orthogonal to the first direction, the side wall surface having a first end and a second end positioned downstream of the first end in the first direction, the proximal wall surface provided on the first end of the side wall surface, the wall surface being formed with a first opening and a second opening, at least one of the first opening and the second opening being formed in the side wall surface. The first air channel is configured to allow air to flow between the valve chamber and ambient air through the first opening. The second air channel is configured to allow air to flow between the liquid chamber and the valve chamber through the second opening. The seal member is provided on the second end of the side wall surface, the seal member being formed with a through-hole defined by a peripheral surface. The valve element has is disposed within the valve chamber and including a closing part configured to contact the seal member to close the through-hole, the valve element having an outer surface. The first sealing part has an annular shape and is provided on the outer surface of the valve element, the first sealing part being in close contact with the side wall surface and configured to move in a second direction opposite to the first direction. The second sealing part has an annular shape and is provided on the outer surface of the valve element at a position toward the second end of the side wall surface from the first sealing part, the second sealing part being in close contact with the side wall surface and configured to move in the second direction, the first sealing part and the second sealing part defining an enclosed space therebetween in the valve chamber. The third sealing part is provided on the closing part and is configured to make close contact with the peripheral surface of the through-hole and slide relative to the peripheral surface. The liquid channel is configured to allow liquid to flow between the liquid chamber and a portion of the valve chamber toward the second end of the side wall surface from the second sealing part. The valve element is configured to move in the second direction from a first state to a second state and then to a third state. In the first state, the closing part closes the through-hole of the seal member, the first sealing part interrupting air flow between the first opening and the second opening and the second sealing part being positioned toward the second end of the side wall surface from the first opening and the second opening. In the second state, the third sealing part makes close contact with the peripheral surface of the through-hole, air being allowed to flow between the first opening and the second opening through the enclosed space. In the third state, the third sealing part is separated from the peripheral surface of the through-hole and the liquid channel is in communication with outside of the valve chamber.

DETAILED DESCRIPTION

1. First Embodiment

An ink cartridge 30 according to a first embodiment of the present invention and a printer 10 configured to accommodate the ink cartridge 30 will be described with reference to FIGS. 1 through 8.

<Overall Structure of Printer 10>

Figure 1:
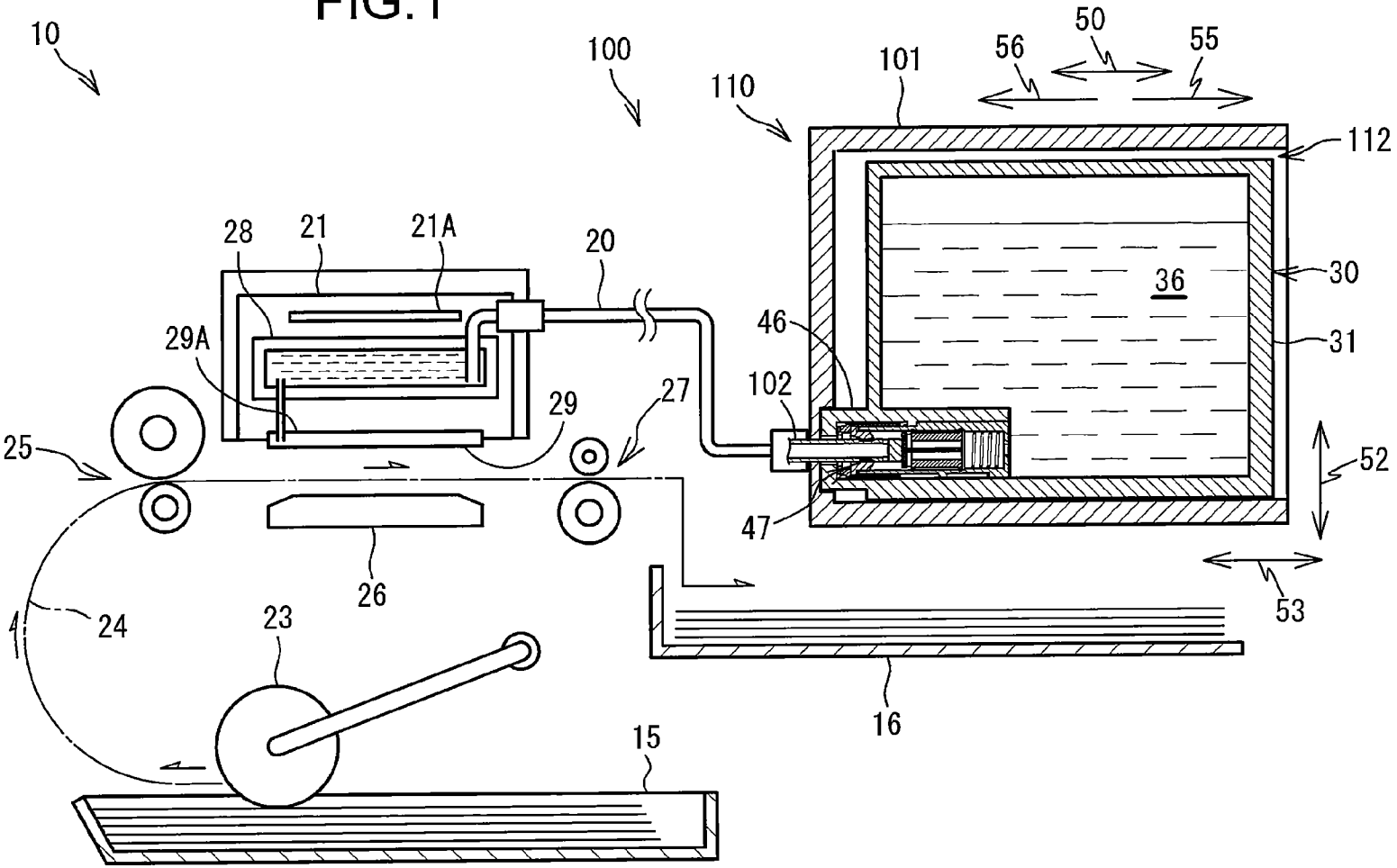
FIG. 1 is a schematic diagram illustrating an internal structure of a printer provided with a cartridge-mounting unit according to a first embodiment of the present invention.

The printer 10 employs an inkjet recording system for recording images on recording paper by selectively ejecting ink droplets toward the paper. As shown in FIG. 1, the printer 10 includes a recording head 21, an ink-supplying device 100 (an example of a liquid supplying device of the invention), and an ink tube 20 connecting the recording head 21 to the ink-supplying device 100.

The ink-supplying device 100 is provided with a cartridge-mounting unit 110. The ink cartridge 30 (an example of a liquid cartridge of the invention) can be mounted in the cartridge-mounting unit 110.

An opening 112 is formed in one side of the cartridge-mounting unit 110. The ink cartridge 30 can be inserted into the cartridge-mounting unit 110 through the opening 112 in a mounting direction 56 (an example of a first direction in the invention) or can be extracted from the cartridge-mounting unit 110 through the opening 112 in a removing direction 55 (an example of a second direction).

The ink cartridge 30 is configured to store ink (an example of liquid in the invention) that the printer 10 can use in image formation. The ink tube 20 connects the ink cartridge 30 to the recording head 21 when the ink cartridge 30 is completely mounted in the cartridge-mounting unit 110.

The recording head 21 is provided with a sub-tank 28, and nozzles 29. The sub-tank 28 temporarily holds ink that is supplied through the ink tube 20. The recording head 21 selectively ejects ink supplied from the sub-tank 28 from the nozzles 29 according to an inkjet recording method. More specifically, the recording head 21 is provided with a head control board 21A, and piezoelectric elements 29A corresponding to each of the nozzles 29. The head control board 21A selectively applies drive voltages to the piezoelectric elements 29A to selectively eject ink from the nozzles 29.

The printer 10 has a paper-conveying mechanism that includes a paper tray 15, a feeding roller 23, a conveying path 24, a pair of conveying rollers 25, a platen 26, a pair of discharge rollers 27, and a discharge tray 16. The feeding roller 23 feeds recording paper from the paper tray 15 onto the conveying path 24, and the conveying rollers 25 convey the recording paper over the platen 26. The recording head 21 selectively ejects ink onto the recording paper as the paper passes over the platen 26, whereby an image is recorded on the paper. The discharge rollers 27 receive the recording paper that has passed over the platen 26 and discharge the paper onto the discharge tray 16 provided on the downstream end of the conveying path 24.

<Ink-Supplying Device 100>

As shown in FIG. 1, the ink-supplying device 100 is provided in the printer 10. The ink-supplying device 100 functions to supply ink to the recording head 21 provided in the printer 10. The ink-supplying device 100 includes the cartridge-mounting unit 110 in which the ink cartridge 30 can be mounted. The cartridge-mounting unit 110 includes a case 101, and an ink needle 102 (an example of a liquid extraction tube of the invention). FIG. 1 shows the state of the ink cartridge 30 when the ink cartridge 30 is completely mounted in the cartridge-mounting unit 110. Note that, while the cartridge-mounting unit 110 is provided with four ink needles 102 and can accommodate four ink cartridges 30 corresponding to the four colors cyan, magenta, yellow, and black, the following description will be concerned with the mutual operations of one ink needle 102 and the corresponding ink cartridge 30.

<Ink Needle 102>

The opening 112 is formed in the case 101. The case 101 has an inner back surface positioned on the opposite side of the case 101 from the opening 112. As shown in FIG. 1, the ink needle 102 protrudes in the removing direction 55 from the inner back surface of the case 101. The ink needle 102 is disposed on the inner back surface of the case 101 at a position for confronting a cylindrical wall 46 (described later) provided in the ink cartridge 30.

Figure 2:
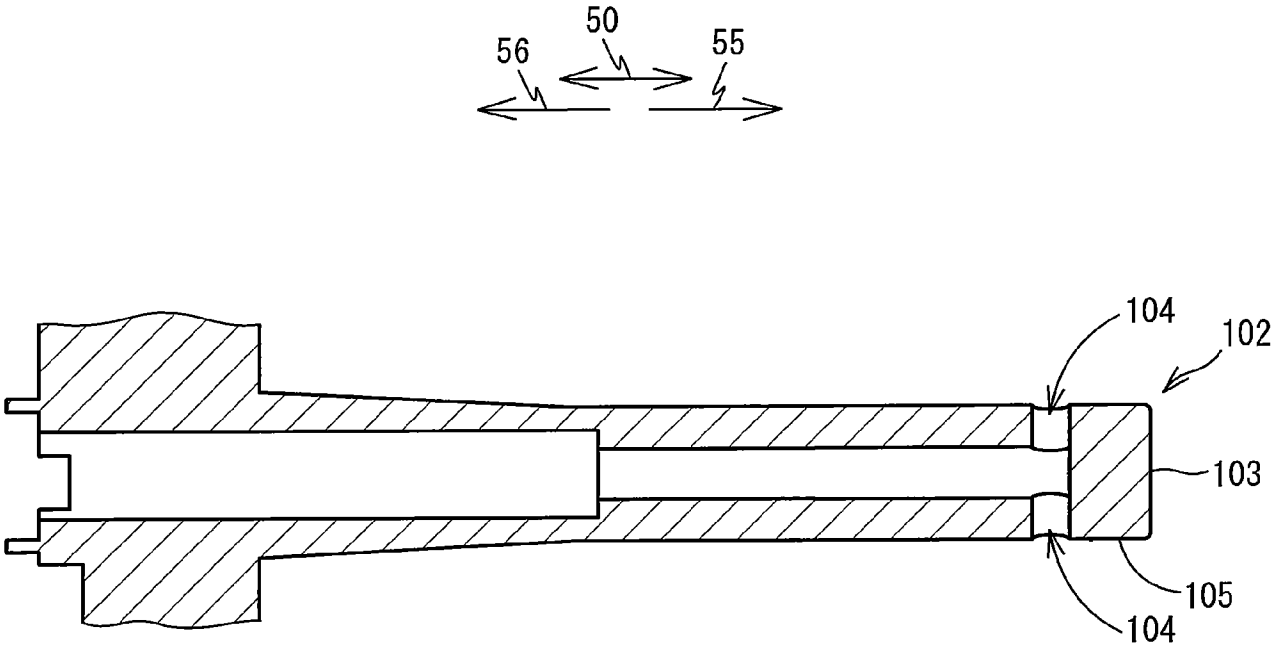
FIG. 2 is a cross-sectional view of an ink needle provided in the cartridge-mounting unit according to the first embodiment.

As shown in FIG. 2, the ink needle 102 is a tube-like needle formed of resin. The ink needle 102 has a liquid channel in the center of the tube that runs along the longitudinal dimension of the ink needle 102. The ink needle 102 has a distal end 103 corresponding to the end that protrudes farthest from the inner back surface of the cartridge-mounting unit 110, and a pair of communication holes 104 formed in a circumferential wall of the ink needle 102 near the distal end 103. Although not shown in FIG. 2, the ink tube 20 is connected to a base end (opposite to the distal end 103) of the ink needle 102. The communication holes 104 are formed at positions slightly separated from the distal end 103 in a direction toward the base end of the ink needle 102, with one each on opposing sides of the central axis of the ink needle 102. The communication holes 104 provide fluid communication between the interior and exterior of the ink needle 102 so that ink can flow therethrough.

A third sealing part 105 constitutes the circumferential surface of the ink needle 102 between the distal end 103 and communication holes 104 and functions to slide over a seal member 70 described later. Communication holes that provide communication between the interior and exterior of the ink needle 102 are not formed in the distal end 103 and third sealing part 105. The dimension of the third sealing part 105 in the mounting and removing directions 50 is larger than a distance in the mounting and removing directions 50 between a first sealing part 84 (described later) and an opening 64 (described later) when a valve element 77 (described later) is in a first state, but is smaller than a distance in the mounting and removing directions 50 between a second sealing part 85 (described later) and an opening 61 (described later) when the valve element 77 is in the first state.

When the ink needle 102 is inserted into the cylindrical wall 46 (described later) far enough for the communication holes 104 to be positioned inside the cylindrical wall 46, ink in an ink chamber 36 described later (an example of a liquid chamber) flows through a valve chamber 47 (described later) formed inside the cylindrical wall 46 into the ink tube 20 connected to the ink needle 102. Note that the definition of "needle" in this specification is a generic term that should include the meaning of a narrow tube-like member and need not be a member with a pointed tip.

<Ink Cartridge 30>

As shown in FIG. 3, the ink cartridge 30 includes a frame 31, and the cylindrical wall 46. The ink chamber 36 is formed inside the frame 31, and the valve chamber 47 (see FIG. 6) is formed inside the cylindrical wall 46. The ink cartridge 30 supplies ink stored in the ink chamber 36 externally through the valve chamber 47. The ink cartridge 30 is inserted in and extracted from the cartridge-mounting unit 110 along the mounting and removing directions 50 while in an erected state shown in FIG. 3, i.e., with the bottom surface of the ink cartridge 30 in FIG. 3 positioned on the bottom and the top surface of the ink cartridge 30 in FIG. 3 positioned on the top. The mounting and removing directions 50 are horizontal directions in the present embodiment. Further, a left-right direction 51 and a front-rear direction 53 with respect to the ink cartridge 30 are also horizontal when the ink cartridge 30 is in its erected state. Up-down direction 52 with respect to the ink cartridge 30 in its erected state is aligned with the direction of gravity (vertical). The removing direction 55 and mounting direction 56 correspond to the mounting and removing directions 50 and are opposing directions to each other. The mounting and removing directions 50 are also aligned with the front-rear direction 53.

<Frame 31>

The frame 31 has an external shape similar to a rectangular parallelepiped that appears flattened in the left-right direction 51 so that the dimension of the frame 31 in the left-right direction 51 is small and the dimensions of the frame 31 in the up-down direction 52 and front-rear direction 53 are greater than the dimension in the left-right direction 51. The frame 31 is configured of a front wall 40 and a rear wall 41 that at least partially overlap each other when projected in the front-rear direction 53, a top wall 39 and a bottom wall 42 that at least partially overlap each other when projected in the up-down direction 52, and a left wall 38 disposed on one side of the frame 31 with respect to the left-right direction 51 (on the left side of the frame 31 when viewing the frame 31 from the front wall 40 side in the example of FIG. 3). The front wall 40 is the side of the frame 31 facing forward when the ink cartridge 30 is mounted in the cartridge-mounting unit 110, while the rear wall 41 faces rearward. The frame 31 is formed of a resin material, for example.

The top wall 39 is connected to top edges of the left wall 38, front wall 40 and rear wall 41. The bottom wall 42 is connected to bottom edges of the left wall 38, front wall 40, and rear wall 41. The left wall 38 is connected to left edges of the top wall 39, front wall 40, rear wall 41, and bottom wall 42. The side of the frame 31 opposite the left wall 38 in the left-right direction 51 (the right side of the frame 31 when viewing the frame 31 from the front wall 40 side in the example of FIG. 3) is open. This open side of the frame 31 is sealed by a film 43. The film 43 has an outer shape substantially equal to the outer shape of the frame 31 when viewed in the left-right direction 51. The film 43 is disposed on the side of the frame 31 opposite the left wall 38 in the left-right direction 51 (the right side) and constitutes a right wall 37 of the ink chamber 36 with respect to the left-right direction 51. The film 43 is heat-sealed to the right end faces of the top wall 39, front wall 40, rear wall 41, and bottom wall 42. The resulting ink chamber 36 defined by the left wall 38, top wall 39, front wall 40, rear wall 41, bottom wall 42, and film 43 can store ink.

<Valve Chamber 47>

Figure 6:
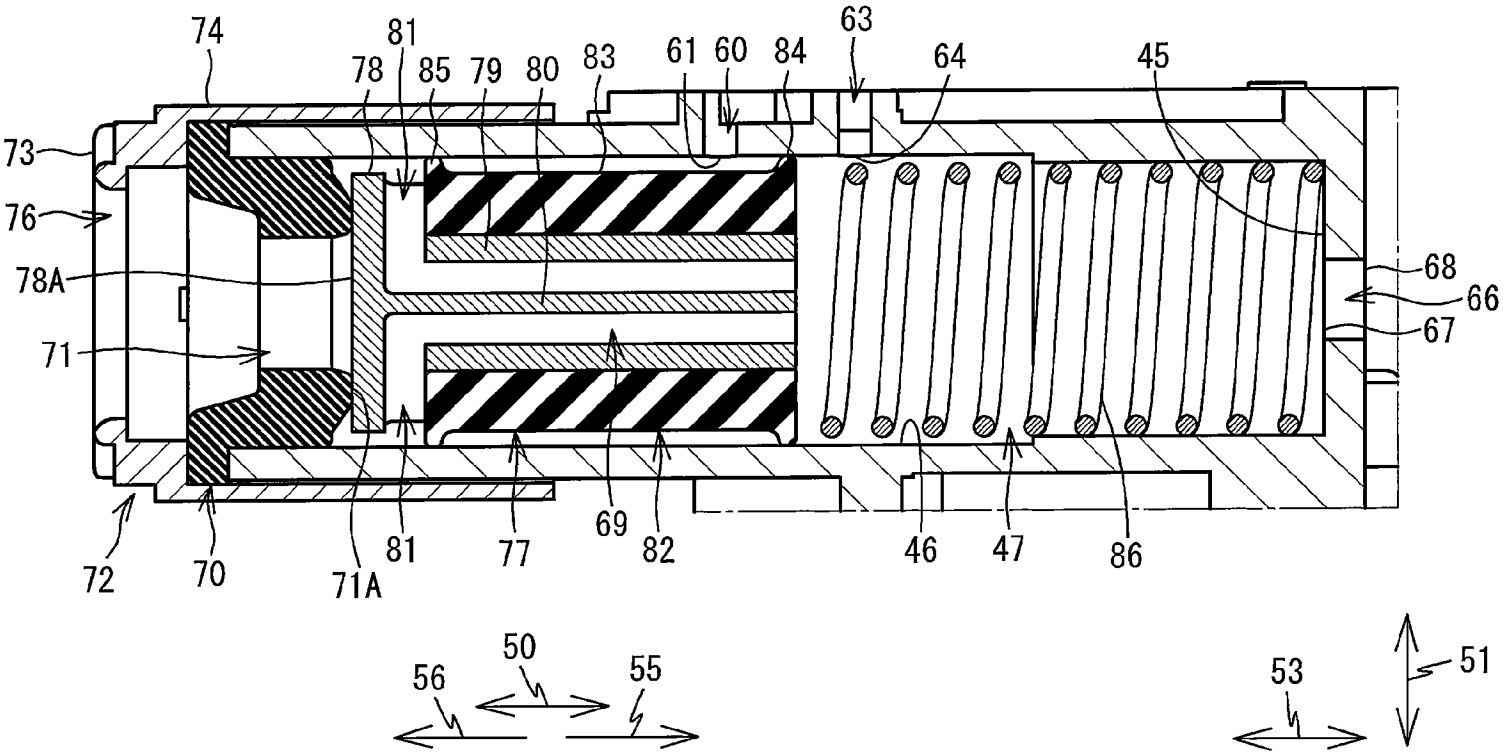
FIG. 6 is an enlarged cross-sectional view of the valve chamber in a horizontal cross section of the ink cartridge according to the first embodiment viewed from below when the valve element is in a first state.

As shown in FIG. 6, the ink cartridge 30 also includes a proximal wall 45 disposed on the end of the cylindrical wall 46 positioned inside the frame 31. The valve chamber 47 is a space defined by surfaces including the front surface of the proximal wall 45 and the inner peripheral surface of the cylindrical wall 46. As shown in FIGS. 1 and 3, the valve chamber 47 is provided on a front portion of the ink cartridge 30 in the front-rear direction 53 and near a bottom portion of the ink cartridge 30 in the up-down direction 52. The proximal wall 45 and cylindrical wall 46 are formed of a resin material, for example. The valve chamber 47 is connected to a first air channel 60, a second air channel 63, and a first liquid channel 66. The seal member 70 and a cap 72 are attached to the distal end of the cylindrical wall 46. The valve element 77, a seal member 82, and a coil spring 86 (an example of a biasing member of the invention) are all accommodated within the cylindrical wall 46.

As shown in FIG. 3, the proximal wall 45 is disposed between the ink chamber 36 and valve chamber 47 that are adjacent to each other in the front-rear direction 53. The cylindrical wall 46 extends forward from the front surface of the proximal wall 45. In other words, the cylindrical wall 46 extends from the front surface of the proximal wall 45 in the mounting direction 56 toward the outside of the ink cartridge 30. The front end of the cylindrical wall 46 protrudes forward from the front wall 40, while the rear end is positioned rearward of the front wall 40. The proximal end of the cylindrical wall 46 (an upstream end in the mounting direction 56; an example of a first end of the invention) is connected to the proximal wall 45, and the distal end of the cylindrical wall 46 (a downstream end in the mounting direction 56; an example of a second end of the invention) is open. The inner peripheral surface of the cylindrical wall 46 is formed continuously in a cross section orthogonal to the mounting direction 56, i.e., is annular. Here, "annular" is not limited to a circular shape, but may be elliptical, rectangular, or the like. The inner peripheral surface of the cylindrical wall 46 is an example of an annular-shaped side wall surface of the invention. The front surface of the proximal wall 45 is an example of a proximal wall surface. Therefore, the proximal end of the cylindrical wall 46 serving as an example of the first end indicates the upstream end of the mounting direction 56 on the inner peripheral surface of the cylindrical wall 46. The distal end of the cylindrical wall 46 serving as an example of the second end of the invention indicates the downstream end in the mounting direction 56 on the inner peripheral surface of the cylindrical wall 46.

Figure 3A:
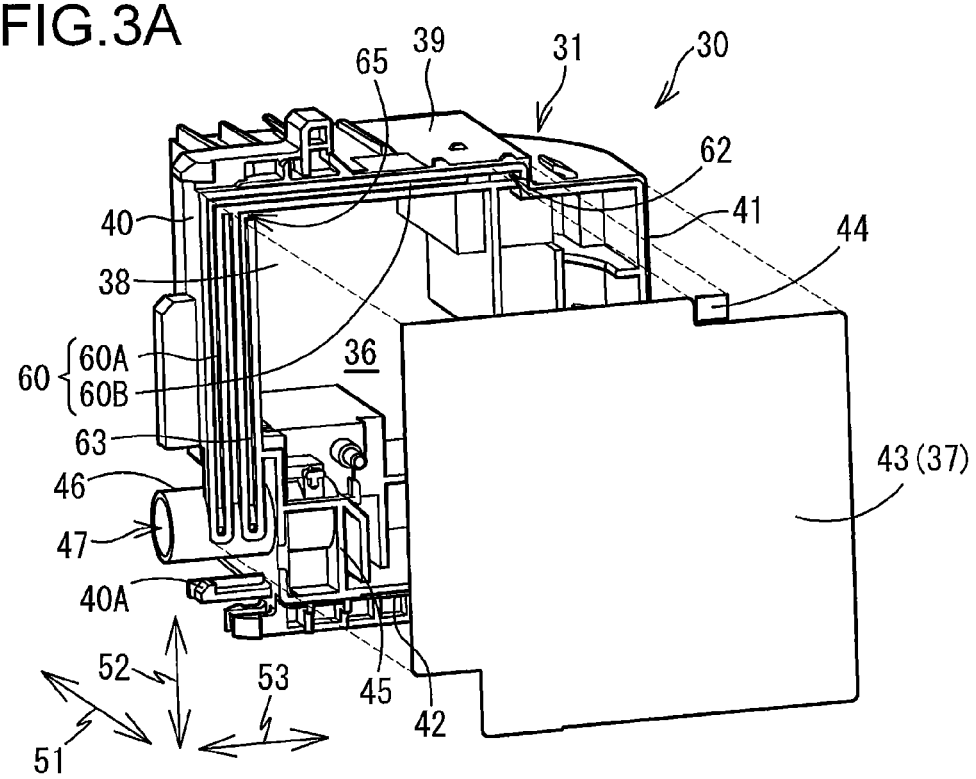
FIG. 3A is a right side perspective view showing a structure of an ink cartridge according to the first embodiment from an upper front perspective.
Figure 3B:
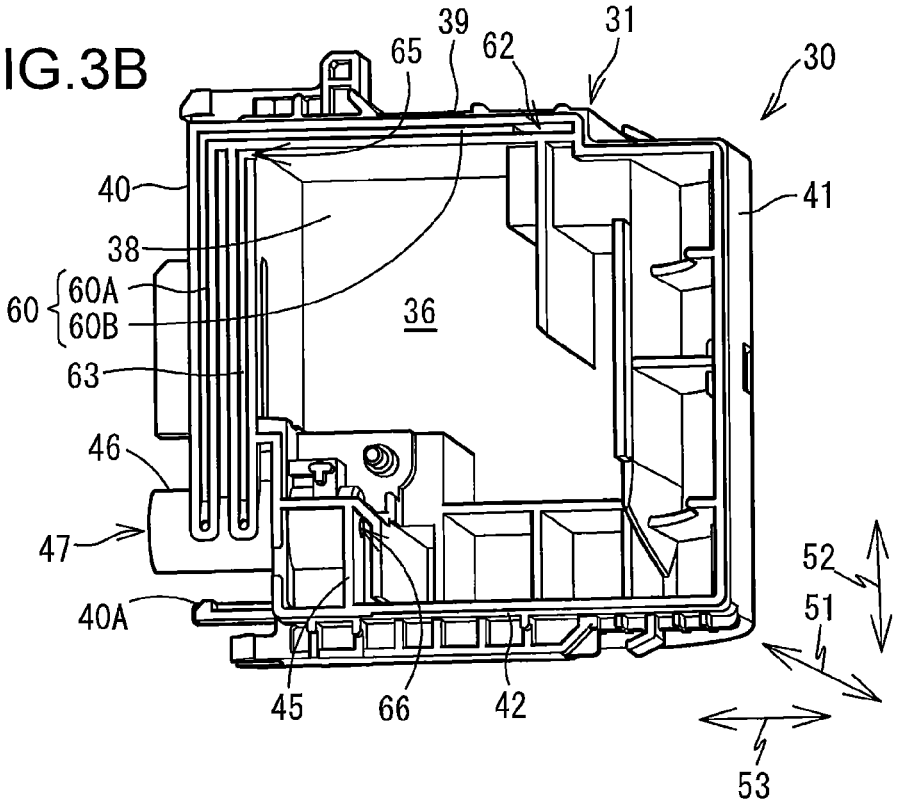
FIG. 3B is a right side perspective view showing the structure of the ink cartridge according to the first embodiment from a lower rear perspective.

The first air channel 60 allows air to flow between the valve chamber 47 and the exterior of the ink cartridge 30. In other words, the first air channel 60 provides communication between the valve chamber 47 and ambient air. Referring to FIGS. 3A and 3B, the first air channel 60 includes a groove 60A and a groove 60B. The groove 60A is formed in a right endface of the front wall 40 and extends in the up-down direction 52. The groove 60B is formed in a right endface of the top wall 39 and extends in the front-rear direction 53 so as to be connected with a top end of the groove 60A. The bottom end of the groove 60A is in communication with the valve chamber 47 through the opening 61 (an example of a first opening in the invention; also see FIG. 6) formed in the inner peripheral surface (i.e., the side wall surface) of the cylindrical wall 46. The rear end of the groove 60B is in communication with the exterior of the ink cartridge 30 through an opening 62 formed in the right endface of the top wall 39.

The second air channel 63 allows air to flow between the valve chamber 47 and ink chamber 36. The second air channel 63 is a groove formed in the right endface of the front wall 40 that extends in the up-down direction 52. Further, the bottom end of the second air channel 63 is in communication with the valve chamber 47 through the opening 64 (an example of a second opening in the invention; also see FIG. 6) formed in the inner peripheral surface of the cylindrical wall 46. The top end of the second air channel 63 is in communication with the ink chamber 36 through an opening 65 formed in a rear surface of the front wall 40 (the surface on the ink chamber 36 side). As shown in FIG. 6, the opening 64 is positioned closer to the proximal end of the cylindrical wall 46 than the opening 61 is to the proximal end of the cylindrical wall 46. The opening 65 is positioned above the level of ink accommodated in the ink chamber 36 of the ink cartridge 30 that is still unused.

As shown in FIG. 3, the first air channel 60 and second air channel 63 are sealed liquid-tight by the film 43 constituting the right wall 37 of the ink cartridge 30. The opening 62 is also sealed by a semipermeable membrane 44. That is, a notch is formed in the film 43 at a position corresponding to the opening 62. The semipermeable membrane 44 is a porous membrane formed with microholes that allow the passage of air while preventing the passage of ink. For example, the semipermeable membrane 44 may be formed of a fluororesin, such as polytetrafluoroethylene, tetrafluoroethylene-hexafluoropropylene copolymer, tetrafluoroethylene-perfluoroalkyl vinyl ether copolymer, or tetrafluoroethylene-ethylene copolymer.

As shown in FIG. 6, the first liquid channel 66 allows ink to flow between the proximal wall 45 side of the valve chamber 47 and the ink chamber 36. In the present embodiment, the first liquid channel 66 is a through-hole that penetrates the proximal wall 45 in its thickness dimension (in the front-rear direction 53 or mounting and removing directions 50). The first liquid channel 66 is in communication with the valve chamber 47 through an opening 67 (an example of a third opening in the invention) formed in the front surface (surface on the valve chamber 47 side) of the proximal wall 45. Thus, the opening 67 is positioned toward the proximal end of the cylindrical wall 46 from the opening 61 and opening 64. The first liquid channel 66 is in communication with the ink chamber 36 through an opening 68 formed in a rear surface (the surface on the ink chamber 36 side) of the proximal wall 45.

Figure 4:
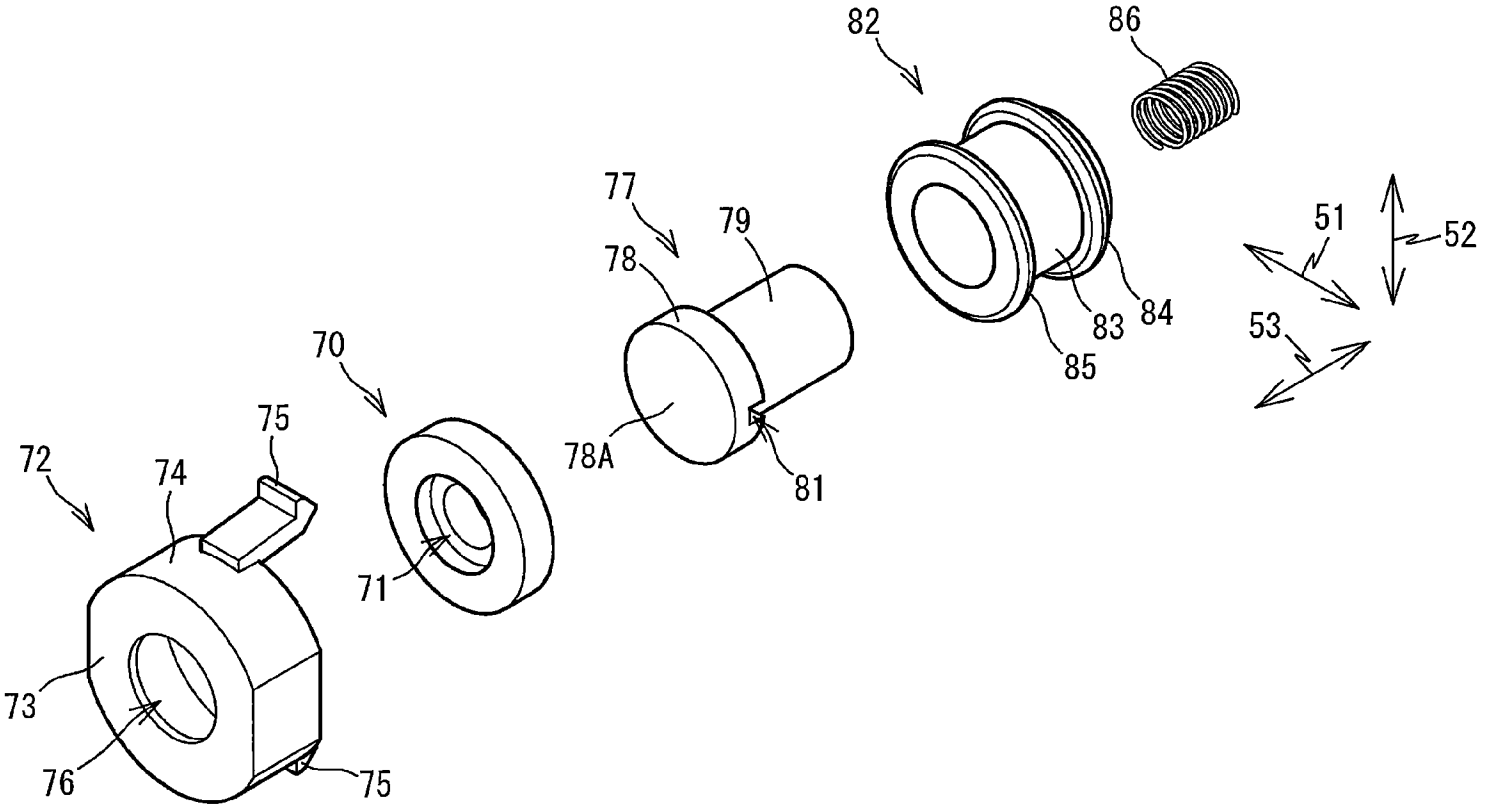
FIG. 4 is an exploded perspective view from the front side showing components that function to open and close a valve chamber in the ink cartridge according to the first embodiment, the components including a valve element.
Figure 5:
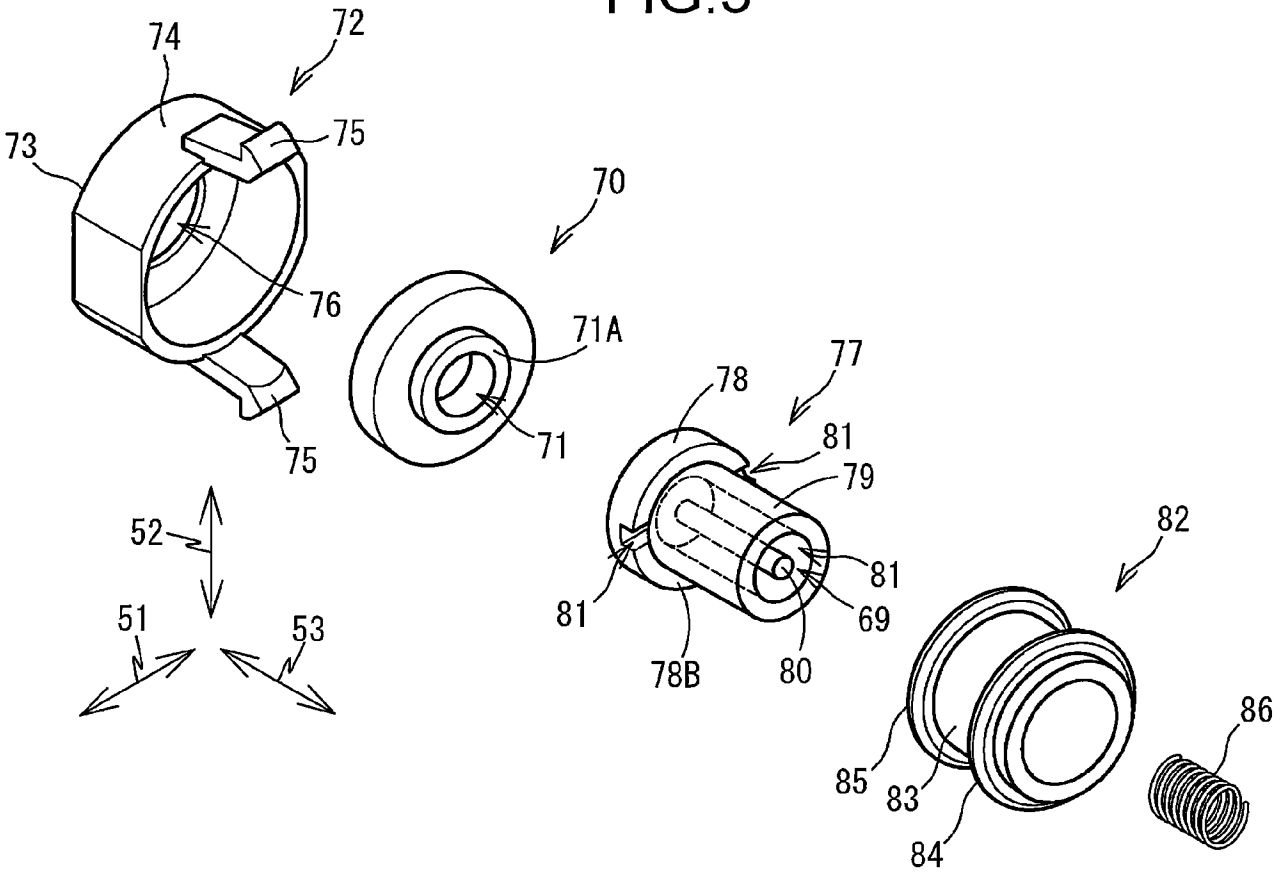
FIG. 5 is an exploded perspective view from the rear side showing the components that function to open and close the valve chamber in the ink cartridge according to the first embodiment.

As shown in FIGS. 4 and 5, the seal member 70 has a disc-shape with an outer diameter substantially equivalent to that of the cylindrical wall 46. The seal member 70 is mounted on the distal end of the cylindrical wall 46 so as to be liquid-tight. A through-hole 71 is formed in the seal member 70 and penetrates a center region of the seal member 70 in its thickness dimension (in the front-rear direction 53 or mounting and removing directions 50). The through-hole 71 provides communication between the interior and exterior of the valve chamber 47. Note that the through-hole 71 has a diameter slightly smaller than the outer diameter of the ink needle 102. A protruding part 71A is formed on the seal member 70 so as to protrude in the removing direction 55 from a peripheral edge of the through-hole 71. The protruding part 71A is an annular protrusion that is formed continuously so as to surround the through-hole 71. The protruding part 71A has an endface (an example of a contact surface of the invention) on the downstream side in the removing direction 55 that is orthogonal to the mounting direction 56 and serves to contact the valve element 77. The seal member 70 is formed of rubber or another elastic material.

As shown in FIGS. 4 and 5, the cap 72 is configured of a disc-shaped cover part 73, a cylindrical part 74 that protrudes from one surface (rear surface) of the cover part 73 in its thickness dimension (i.e., in the front-rear direction 53 or mounting and removing directions 50), and engaging parts 75 that protrude away from the cover part 73 from a protruding edge of the cylindrical part 74. A through-hole 76 is formed in the cover part 73 and penetrates a center region of the cover part 73 in its thickness direction. The through-hole 76 has a diameter larger than that of the through-hole 71. The cylindrical part 74 is provided to surround the through-hole 76. The cap 72 is formed of a resin material, for example.

The cover part 73 contacts the seal member 70 from the side of the seal member 70 opposite the cylindrical wall 46. Hence, the seal member 70 is interposed between the cover part 73 and the distal end of the cylindrical wall 46 in the front-rear direction 53. The cylindrical part 74 covers the outer circumferential surface of the seal member 70 and a portion on the outer peripheral surface of the cylindrical wall 46. The engaging parts 75 engage with engaged parts 40A provided on the front wall 40 (see FIGS. 3A and 3B). The cap 72 holds the seal member 70 on the distal end of the cylindrical wall 46.

As shown in FIGS. 4 and 5, the valve element 77 is configured of a disc-shaped valve 78, a cylindrical retaining part 79, and a protruding member 80 that protrudes from the valve 78 toward the proximal end of the cylindrical wall 46. The valve element 77 is disposed in the valve chamber 47, with the valve 78 facing the distal end of the cylindrical wall 46 and the retaining part 79 facing the proximal end of the cylindrical wall 46 and is capable of moving in the front-rear direction 53. The valve element 77 is formed of a material having greater rigidity than the seal member 82 (a resin material, for example).

The valve 78 has a front surface 78A (an example of a closing part of the invention) that can tightly contact the endface of the protruding part 71A of the seal member 70, and a rear surface 78B on the opposite side of the valve 78 from the front surface 78A. The retaining part 79 and protruding member 80 protrude from the rear surface 78B. The outer dimension of the valve 78 is larger than the diameter of the through-hole 71 and smaller than the inner diameter of the cylindrical wall 46. The retaining part 79 protrudes from the rear surface 78B of the valve 78 at a position surrounding the protruding member 80 toward the proximal end of the cylindrical wall 46. An opening (an example of a fourth opening) is formed in an end of the retaining part 79 facing the proximal wall 45. The outer diameter of the retaining part 79 is smaller than the inner diameter of the cylindrical wall 46.

The protruding member 80 extends from the rear surface 78B of the valve 78 toward the proximal end of the cylindrical wall 46 and is arranged to face the opening 67 formed in the front surface of the proximal wall 45. A second liquid channel 69 is formed in the valve element 77. The second liquid channel 69 is configured of a space inside the retaining part 79 and surrounding the protruding member 80, and two grooves 81 that extend radially outward from this space along the rear surface 78B of the valve 78. Outer radial ends of the grooves 81 are an example of a fifth opening of the invention.

The seal member 82 is configured of a cylindrical part 83 that fits around the outer circumferential surface of the retaining part 79, and flange-like first and second sealing parts 84 and 85 that protrude radially outward from the outer circumferential surface of the cylindrical part 83. The seal member 82 is formed of a rubber or other elastic material, for example. The first and second sealing parts 84 and 85 are separated from each other in the front-rear direction 53. More specifically, the first sealing part 84 is provided closer to the proximal end of the cylindrical wall 46 than the second sealing part 85 is, and thus conversely, the second sealing part 85 is provided nearer to the distal end of the cylindrical wall 46 than the first sealing part 84 is (i.e., the second sealing part 85 is provided at a position toward the distal end of the cylindrical wall 46 from the first sealing part 84). The seal member 82 moves in the front-rear direction 53 within the valve chamber 47 together with the valve element 77. Through the movement of the valve element 77, the first and second sealing parts 84 and 85 slide along the inner peripheral surface of the cylindrical wall 46.

As shown in FIG. 6, the first and second sealing parts 84 and 85 make close contact with the inner peripheral surface of the cylindrical wall 46 to provide an airtight seal. The outer diameter of the first and second sealing parts 84 and 85 is greater than the inner diameter of the cylindrical wall 46 when the seal member 82 is not inserted in the valve chamber 47. In other words, the first and second sealing parts 84 and 85 elastically deform inward in a direction that reduces their outer diameters when contacting the inner peripheral surface of the cylindrical wall 46. Thus, the space on the proximal side of the valve chamber 47 is shutoff from the space on the distal side of the valve chamber 47 on the outside of the valve element 77. Air can circulate in the enclosed space formed between the first and second sealing parts 84 and 85.

The space on the proximal wall 45 side of the valve chamber 47 can communicate with the space on the distal side of the valve chamber 47 through the second liquid channel 69 formed inside the valve element 77. The first and second liquid channels 66 and 69 constitute part of the liquid channel that allows liquid flow between the ink chamber 36 and a portion of the valve chamber 47 on the distal end side of the second sealing part 85.

The coil spring 86 is disposed between the proximal wall 45 and valve element 77. More specifically, one end of the coil spring 86 contacts the front surface of the proximal wall 45, and the other end contacts the surface of the valve element 77 (more specifically, the retaining part 79) facing the proximal wall 45. The coil spring 86 biases the valve element 77 toward the distal end of the cylindrical wall 46 in order to maintain the valve element 77 in the first state (see FIG. 6) within the valve chamber 47 in which the valve 78 contacts the seal member 70. Note that a plate spring or other urging member may be used in place of the coil spring 86.

<Operations for Mounting the Ink Cartridge 30 in the Cartridge-Mounting Unit 110>

Next, the movement of the valve element 77 during the process of mounting the ink cartridge 30 in the cartridge-mounting unit 110 will be described with reference to FIGS. 6 through 8.

Prior to the ink cartridge 30 being mounted in the cartridge-mounting unit 110, the valve element 77 is in the first state shown in FIG. 6. In the first state, the valve element 77 is made to contact the seal member 70 by the biasing force of the coil spring 86. More specifically, when the valve element 77 is in this first state, the front surface 78A of the valve 78 contacts the protruding part 71A at the peripheral region of the through-hole 71 formed in the seal member 70 to form a liquid-tight seal with the protruding part 71A. Thus, the valve 78 blocks the through-hole 71, and the liquid channel formed by the first liquid channel 66, second liquid channel 69, and the like is sealed off from the outside of the valve chamber 47 at the through-hole 71.

At this time, the first sealing part 84 is positioned between the openings 61 and 64. That is, the first sealing part 84 forms an airtight seal with the inner peripheral surface of the cylindrical wall 46 at a position toward the proximal end of the cylindrical wall 46 from the opening 61 and toward the distal end of the cylindrical wall 46 from the opening 64. With this arrangement, the first sealing part 84 interrupts communication between the first and second air channels 60 and 63. Note that the first sealing part 84 may be arranged to overlap a portion of the openings 61 and 64, provided that communication is interrupted between the first and second air channels 60 and 63. The second sealing part 85 contacts and forms an airtight seal with the inner peripheral surface of the cylindrical wall 46 at a position toward the distal end of the cylindrical wall 46 from the opening 61. In this way, the second sealing part 85 interrupts communication between the first air channel 60 and the through-hole 71. The second sealing part 85 may also overlap a portion of the opening 61, provided that communication is interrupted between the first air channel 60 and through-hole 71.

Figure 7:
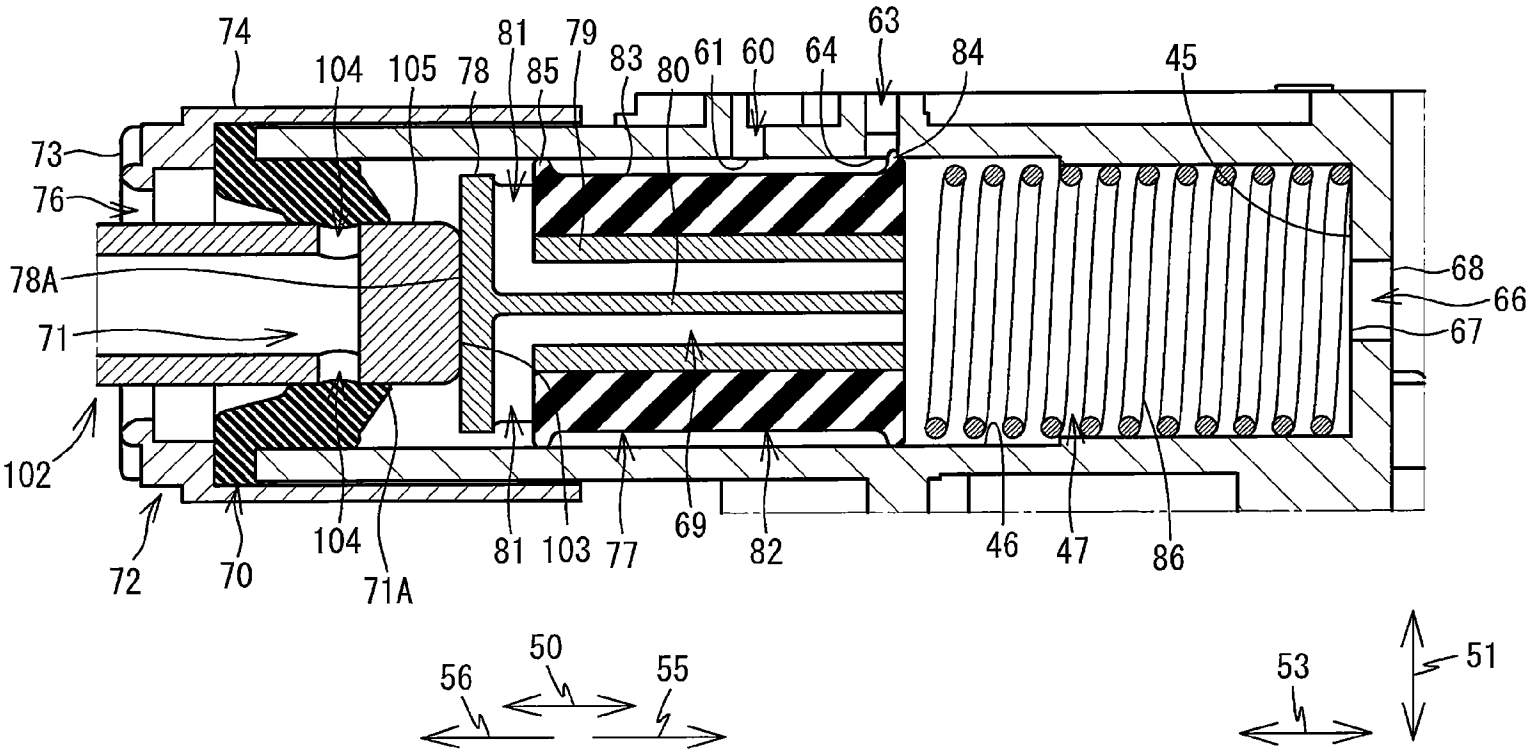
FIG. 7 is an enlarged cross-sectional view of the valve chamber in a horizontal cross section of the ink cartridge according to the first embodiment viewed from below when the valve element is in a second state.

FIG. 7 shows the state of components in the valve chamber 47 as the ink cartridge 30 is being mounted in the cartridge-mounting unit 110 (as the ink needle 102 is being inserted into the valve chamber 47). When the ink cartridge 30 is in the process of being mounted into the cartridge-mounting unit 110, the valve element 77 moves against the biasing force of the coil spring 86 toward the proximal wall 45 side of the cylindrical wall 46 (in the removing direction 55) from the first state toward a second state shown in FIG. 7 due to pressure from the ink needle 102 inserted into the valve chamber 47 through the through-hole 76 and through-hole 71.

When the valve element 77 is in the second state, the front surface 78A of the valve 78 is separated from the seal member 70. At this time, the third sealing part 105 and the communication holes 104 on the distal end of the ink needle 102 are inserted into the through-hole 71 of the seal member 70 and pressed against the seal member 70, but the communication holes 104 have not yet advanced into the valve chamber 47 beyond the through-hole 71. That is, the third sealing part 105 of the ink needle 102 tightly contacts an inner circumferential surface (peripheral surface) of the seal member 70 defining the through-hole 71, causing the inner circumferential surface to elastically deform in a radial direction thereof, and part of the distal end of the third sealing part 105 has advanced into the valve chamber 47, but the communication holes 104 are still sealed by the inner circumferential surface of the seal member 70 at the through-hole 71. Therefore, while the front surface 78A of the valve 78 is separated from the seal member 70, the valve chamber 47 and the internal space of the ink needle 102 are not in communication with each other. In other words, the liquid channel formed by the first liquid channel 66, second liquid channel 69, and the like is still sealed off from outside the valve chamber 47 at the through-hole 71.

When the valve element 77 is in the second state, the first sealing part 84 is positioned between the openings 64 and 67. Specifically, the first sealing part 84 contacts and forms an airtight seal with the inner peripheral surface of the cylindrical wall 46 at a position toward the proximal wall 45 side of the cylindrical wall 46 from the opening 64 and toward the distal end of the cylindrical wall 46 from the opening 67. Thus, the first sealing part 84 allows communication between the first air channel 60 and second air channel 63, but interrupts communication between the second air channel 63 and first liquid channel 66. Therefore, the ink chamber 36 is in communication with ambient air through the first air channel 60, the enclosed space between the first and second sealing parts 84 and 85 (the valve chamber 47), and the second air channel 63. The second sealing part 85 contacts and forms an airtight seal with the inner peripheral surface of the cylindrical wall 46 at a position toward the distal end of the cylindrical wall 46 from the opening 61. Accordingly, the second sealing part 85 interrupts communication between the first and second air channels 60 and 63 and the through-hole 71.

Figure 8:
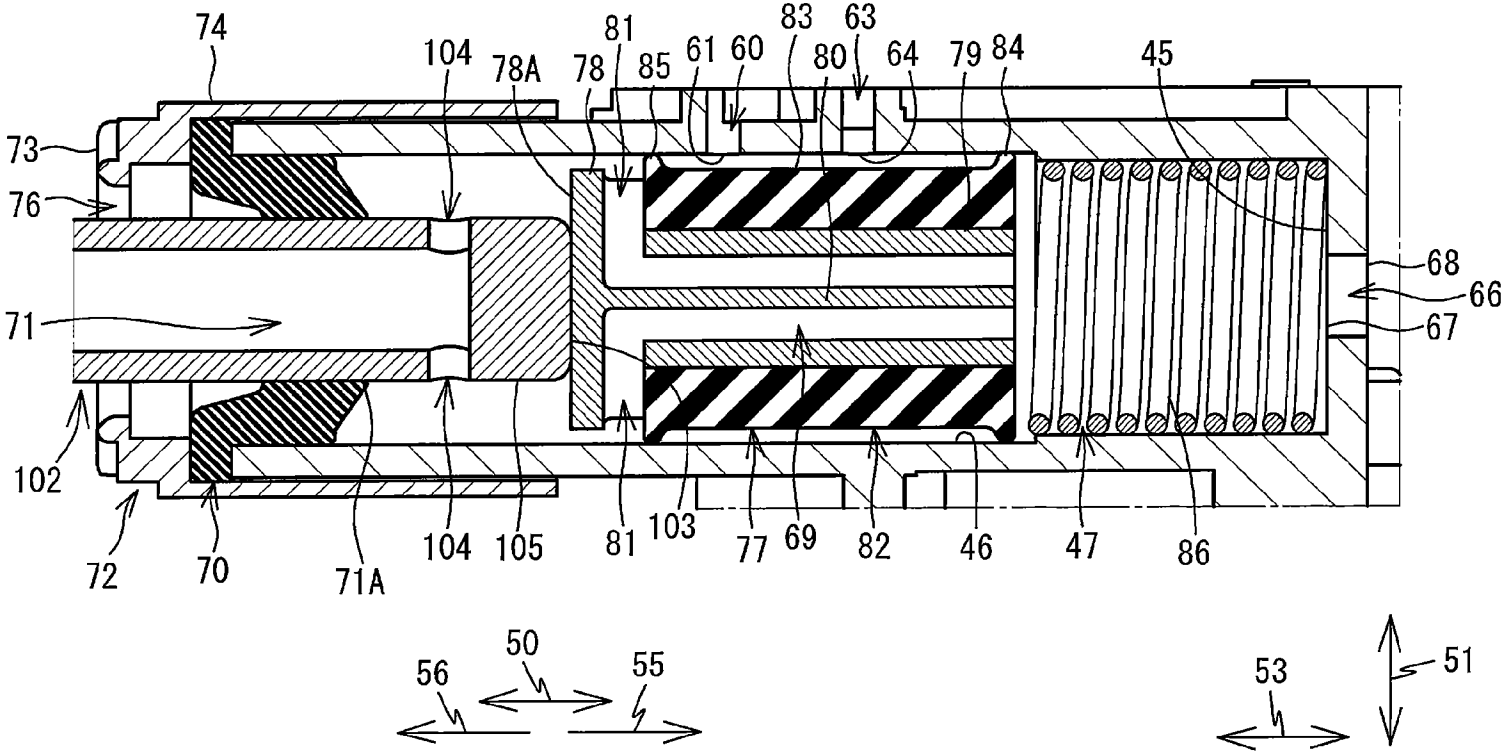
FIG. 8 is an enlarged cross-sectional view of the valve chamber in a horizontal cross section of the ink cartridge according to the first embodiment viewed from below when the valve element is in a third state.

FIG. 8 shows the state of components in the valve chamber 47 once the ink cartridge 30 has been completely mounted in the cartridge-mounting unit 110 (in a state where ink can be supplied from the ink cartridge 30). When the ink cartridge 30 is completely mounted in the cartridge-mounting unit 110, the valve element 77 is in a third state closer to the proximal end of the cylindrical wall 46 than in the second state. In this third state, the ink needle 102 has been inserted farther into the valve chamber 47, pressing the valve element 77 farther toward the proximal end of the cylindrical wall 46 against the biasing force of the coil spring 86.

When the valve element 77 is in this third state, the front surface 78A of the valve 78 is separated from the seal member 70, the ink needle 102 is inserted farther through the through-hole 71 of the seal member 70 and contacts the seal member 70 with pressure, and both the third sealing part 105 and communication holes 104 have advanced past the through-hole 71 into the valve chamber 47. Consequently, the liquid channel formed by the first liquid channel 66, second liquid channel 69, and the like is in communication with the internal space (liquid channel) in the ink needle 102 through the communication holes 104, allowing ink in the ink chamber 36 to flow out of the ink cartridge 30 through the liquid channel (the first liquid channel 66, second liquid channel 69) and the liquid channel in the ink needle 102.

At this time, the first sealing part 84 is positioned between the openings 64 and 67. Specifically, the first sealing part 84 contacts and forms an airtight seal with the inner peripheral surface of the cylindrical wall 46 at a position toward the proximal end of the cylindrical wall 46 from the opening 64 and toward the distal end of the cylindrical wall 46 from the opening 67. Accordingly, the first sealing part 84 allows communication between the first and second air channels 60 and 63, while interrupting communication between the second air channel 63 and first liquid channel 66. Hence, the ink chamber 36 is in communication with ambient air through the first air channel 60, the enclosed space between the first and second sealing parts 84 and 85 (the valve chamber 47), and the second air channel 63. The second sealing part 85 also contacts and forms an airtight seal with the inner peripheral surface of the cylindrical wall 46 at a position toward the distal end of the cylindrical wall 46 from the opening 61. Accordingly, the second sealing part 85 interrupts communication between the first and second air channels 60 and 63 and the through-hole 71.

Operational Advantages of the First Embodiment

According to the configuration of the first embodiment described above, the front surface 78A of the valve element 77 closes off the through-hole 71 formed in the seal member 70 when the valve element 77 is in the first state, preventing ink from flowing out of the ink cartridge 30. The ink chamber 36 is also an enclosed space at this time. When the valve element 77 is in the second state, the ink chamber 36 is in communication with ambient air through the first air channel 60, the enclosed space between the first and second sealing parts 84 and 85 (the valve chamber 47), and the second air channel 63. However, the third sealing part 105 is in close contact with the seal member 70, and the communication holes 104 are blocked by the same. Since the communication holes 104 have not advanced into the valve chamber 47, the ink chamber 36 is not in communication with the internal space of the ink needle 102. When the valve element 77 is in the third state, the third sealing part 105 has separated from the seal member 70, and the communication holes 104 have advanced into the valve chamber 47. At this time, the ink chamber 36 is in communication with the internal space of the ink needle 102 through the first liquid channel 66, second liquid channel 69, valve chamber 47, and communication holes 104.

Further, since the ink needle 102 contacts the front surface 78A of the valve element 77 and pushes the valve element 77 in the removing direction 55 relative to the seal member 70, the valve element 77 moves in the removing direction 55 against the biasing force of the coil spring 86. When the ink needle 102 separates from the front surface 78A, the biasing force of the coil spring 86 moves the valve element 77 in the mounting direction 56. Accordingly, when the ink needle 102 is extracted from the through-hole 71 of the seal member 70, the through-hole 71 is contacted by the front surface 78A of the valve element 77 and immediately blocked by the same.

Further, since the protruding part 71A of the seal member 70 receives the biasing force of the coil spring 86, the coil spring 86 remains in a compressed state from its natural length and can maintain the valve element 77 in the first state. This configuration allows the valve chamber 47 to be more compact.

Further, since the openings 61 and 64 are formed in a side wall of the valve chamber 47 (inner peripheral surface of the cylindrical wall 46), the distance between the openings 61 and 64 can be shortened.

Further, by providing the first and second liquid channels 66 and 69, the ink channel from the ink chamber 36 to the seal member 70 can be made simple and short.

By forming the opening 67 in the proximal wall 45, the first sealing part 84 will not move further toward the proximal wall 45 than the opening 67. Thus, the moving range of the valve element 77 can be set without consideration for the positional relationship of the first sealing part 84 and opening 67.

Further, the inner peripheral surface of the cylindrical wall 46 and the outer surface of the seal member 82 in a cross section taken orthogonal to the mounting direction 56 are circular in shape. Further, since the first and second sealing parts 84 and 85 are flange-like members that protrude radially outward from the outer surface of the valve element 77 and are formed continuously around the circumference of the valve element 77, the valve element 77 need not be positioned in the valve chamber 47 with respect to its circumferential direction, thereby simplifying the construction.

2. Second Embodiment

A configuration according to a second embodiment of the present invention will be described next with reference to FIGS. 9 through 11.

In the first embodiment described above, the ink needle 102 is provided with the third sealing part 105, but the third sealing part 105 is not provided on an ink needle 202 according to the second embodiment. Instead, a third sealing part 287 is provided on a valve 278 of a valve element 277 of the second embodiment. The remaining structures in the second embodiment are generally the same as the structures in the first embodiment and, hence, a detailed description therefor has been omitted. Parts and components in FIGS. 9 through 11 having the same reference numerals used in the first embodiment have the same structures as these components in the first embodiment.

Figure 10:
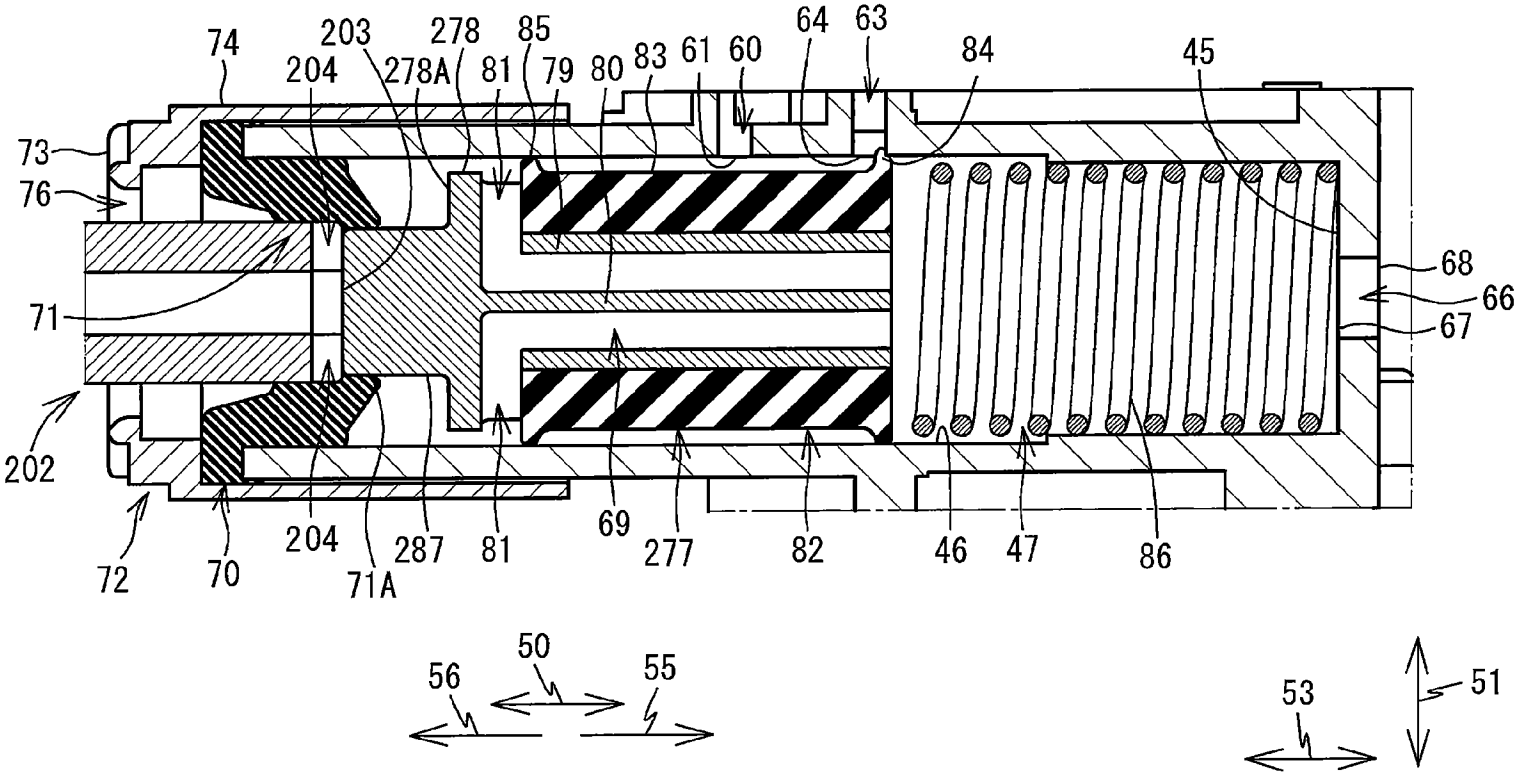
FIG. 10 is an enlarged cross-sectional view of the valve chamber in a horizontal cross section of the ink cartridge according to the second embodiment viewed from below when the valve element is in a second state.
Figure 11:
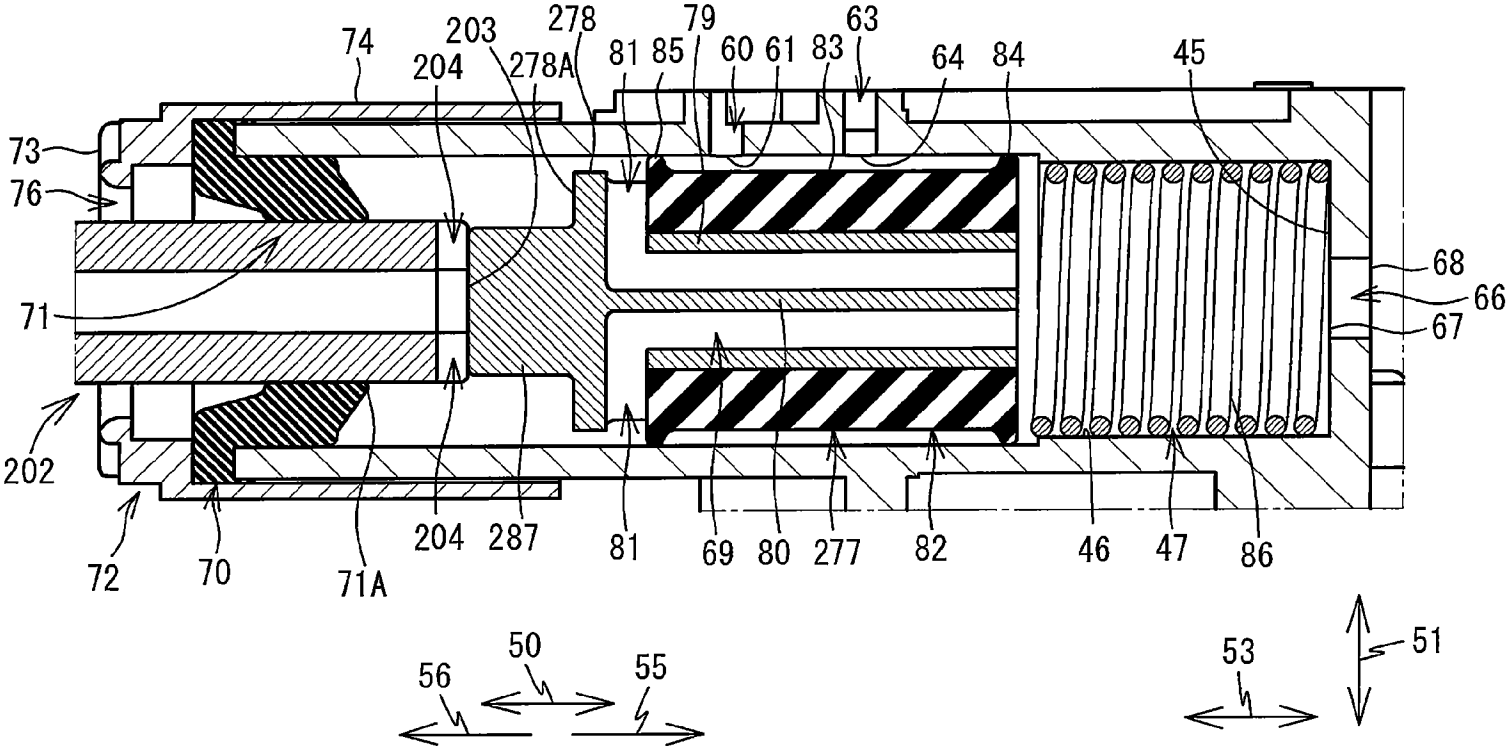
FIG. 11 is an enlarged cross-sectional view of the valve chamber in a horizontal cross section of the ink cartridge according to the second embodiment viewed from below when the valve element is in a third state.

More specifically, as shown in FIGS. 10 and 11, the ink needle 202 of the second embodiment is not provided with the third sealing part 105 on a distal end 203 of the ink needle 202, and communication holes 204 are formed in a circumferential wall of the distal end 203 of the ink needle 202. In other words, in the second embodiment, the communication holes 204 are positioned closer to the distal end 203 than the communication holes 104 are to the distal end 103. Accordingly, there is no, or almost no, circumferential wall between the distal end 203 of the ink needle 202 and the communication holes 204. Thus, the length of the ink needle 202 in the mounting and removing directions 50 between the distal end 203 and communication holes 204 is shorter than the distance between the first sealing part 84 and opening 64 in the mounting and removing directions 50 when the valve element 277 is in the first state. Further, the distance by which the ink needle 202 protrudes in the removing direction 55 from the inner back surface of the case 101 constituting the cartridge-mounting unit 110 is shorter than the protruding length of the ink needle 102 of the first embodiment by the dimension of the third sealing part 105.

Figure 9:
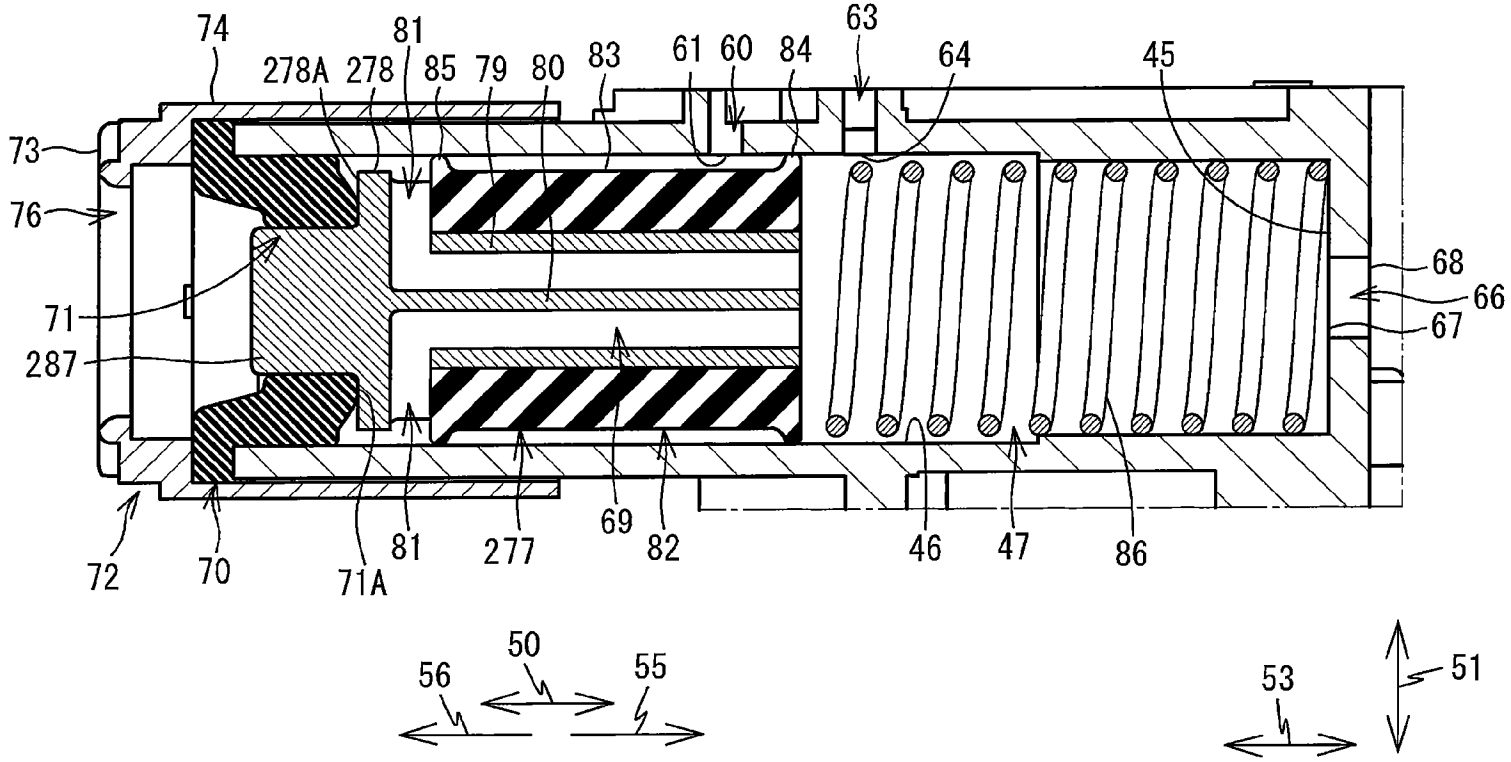
FIG. 9 is an enlarged cross-sectional view of the valve chamber in a horizontal cross section of an ink cartridge according to a second embodiment viewed from below when a valve element is in a first state.

As shown in FIG. 9, the valve element 277 is provided with the third sealing part 287 that protrudes in the mounting direction 56 from a front surface 278A of the valve 278, while the front surface 278A is capable of forming a liquid-tight seal with the distal end of the protruding part 71A protruding from the seal member 70. The third sealing part 287 has a columnar shape, with an outer diameter slightly larger than the inner diameter of the through-hole 71 formed in the seal member 70. Therefore, when the third sealing part 287 is inserted into the through-hole 71 of the seal member 70, the third sealing part 287 contacts the inner circumferential surface of the seal member 70 defining the through-hole 71 to form a liquid-tight seal in the through-hole 71. The dimension of the third sealing part 287 in the mounting and removing directions 50 is greater than the distance in the mounting and removing directions 50 between the first sealing part 84 and opening 64 when the valve element 277 is in the first state, and shorter than the distance in the mounting and removing directions 50 between the second sealing part 85 and opening 61 when the valve element 277 is in the first state.

Prior to the ink cartridge 30 being mounted in the cartridge-mounting unit 110, the valve element 277 is in a first state shown in FIG. 9. In the first state, the valve element 277 is made to contact the seal member 70 by the biasing force of the coil spring 86. Further, the third sealing part 287 is inserted into the through-hole 71 of the seal member 70 and forms a liquid-tight seal with the inner circumferential surface defining the through-hole 71. More specifically, when the valve element 277 is in this first state, the front surface 278A of the valve 278 contacts the protruding part 71A at the peripheral region of the through-hole 71 formed in the seal member 70 and forms a liquid-tight seal with the protruding part 71A. Thus, the valve 278 blocks the through-hole 71, and the liquid channel formed by the first liquid channel 66, second liquid channel 69, and the like is sealed off from outside of the valve chamber 47 at the through-hole 71.

At this time, the first sealing part 84 is positioned between the openings 61 and 64. That is, the first sealing part 84 forms an airtight seal with the inner peripheral surface of the cylindrical wall 46 at a position toward the proximal end of the cylindrical wall 46 from the opening 61 and toward the distal end of the cylindrical wall 46 from the opening 64. With this arrangement, the first sealing part 84 interrupts communication between the first and second air channels 60 and 63. The second sealing part 85 contacts and forms an airtight seal with the inner peripheral surface of the cylindrical wall 46 at a position toward the distal end of the cylindrical wall 46 from the opening 61. In this way, the second sealing part 85 interrupts communication between the first air channel 60 and the through-hole 71.

FIG. 10 shows the state of components in the valve chamber 47 as the ink cartridge 30 is being mounted in the cartridge-mounting unit 110 (as the ink needle 202 is being inserted into the through-hole 71 of the seal member 70). When the ink cartridge 30 is in the process of being mounted into the cartridge-mounting unit 110, the valve element 277 moves against the biasing force of the coil spring 86 toward the proximal wall 45 side of the cylindrical wall 46 (in the removing direction 55) from the first state toward the second state due to pressure from the ink needle 202 inserted into the valve chamber 47 through the through-holes 76 and 71.

When the valve element 277 is in the second state, the front surface 278A of the valve 278 is separated from the seal member 70. However, a portion of the third sealing part 287 remains inserted in the through-hole 71 of the seal member 70. Accordingly, the communication holes 204 formed in the distal end 203 of the ink needle 202 have advanced into the through-hole 71 of the seal member 70 and are pressed against the seal member 70, but the communication holes 204 have not yet advanced into the valve chamber 47 past the through-hole 71. That is, the through-hole 71 is still sealed because a portion of the third sealing part 287 provided on the valve 278 contacts the inner circumferential surface of the seal member 70 defining the through-hole 71. Therefore, while the front surface 278A of the valve 278 is separated from the seal member 70, the valve chamber 47 and the internal space of the ink needle 202 are not in communication with each other. In other words, the liquid channel formed by the first liquid channel 66, second liquid channel 69, and the like is still sealed off from outside the valve chamber 47 at the through-hole 71.

When the valve element 277 is in the second state, the first sealing part 84 is positioned between the openings 64 and 67. Specifically, the first sealing part 84 contacts and forms an airtight seal with the inner peripheral surface of the cylindrical wall 46 at a position toward the proximal wall 45 side of the cylindrical wall 46 from the opening 64 and toward the distal end of the cylindrical wall 46 from the opening 67. Thus, the first sealing part 84 allows communication between the first air channel 60 and second air channel 63, but interrupts communication between the second air channel 63 and first liquid channel 66. Therefore, the ink chamber 36 is in communication with ambient air through the first air channel 60, the enclosed space between the first and second sealing parts 84 and 85 (the valve chamber 47), and the second air channel 63. The second sealing part 85 contacts and forms an airtight seal with the inner peripheral surface of the cylindrical wall 46 at a position toward the distal end of the cylindrical wall 46 from the opening 61. Accordingly, the second sealing part 85 interrupts communication between the first and second air channels 60 and 63 and the through-hole 71.

FIG. 11 shows the state of components in the valve chamber 47 once the ink cartridge 30 has been completely mounted in the cartridge-mounting unit 110 (when ink can be supplied from the ink cartridge 30). When the ink cartridge 30 is completely mounted in the cartridge-mounting unit 110, the valve element 277 is in a third state closer to the proximal end of the cylindrical wall 46 than in the second state. In this third state, the ink needle 202 has been inserted farther into the valve chamber 47, pressing the valve element 727 farther toward the proximal end of the cylindrical wall 46 against the biasing force of the coil spring 86.

When the valve element 277 is in this third state, the front surface 278A of the valve 278 is separated from the seal member 70, and the third sealing part 287 is completely extracted from the through-hole 71 formed in the seal member 70. At this time, the ink needle 202 is inserted farther through the through-hole 71 of the seal member 70 so that the communication holes 204 have passed the through-hole 71 and advanced into the valve chamber 47. Consequently, the liquid channel formed by the first liquid channel 66, second liquid channel 69, and the like is in communication with the liquid channel in the ink needle 202 through the communication holes 204, allowing ink in the ink chamber 36 to flow out of the ink cartridge 30 through the liquid channels formed in the first liquid channel 66, second liquid channel 69, and ink needle 202.

At this time, the first sealing part 84 is positioned between the openings 64 and 67. Specifically, the first sealing part 84 contacts and forms an airtight seal with the inner peripheral surface of the cylindrical wall 46 at a position toward the proximal end of the cylindrical wall 46 from the opening 64 and toward the distal end of the cylindrical wall 46 from the opening 67. Accordingly, the first sealing part 84 allows communication between the first and second air channels 60 and 63, while interrupting communication between the second air channel 63 and first liquid channel 66. Hence, the ink chamber 36 is in communication with the external air through the first air channel 60, the enclosed space between the first and second sealing parts 84 and 85 (the valve chamber 47), and the second air channel 63. The second sealing part 85 also contacts and forms an airtight seal with the inner peripheral surface of the cylindrical wall 46 at a position toward the distal end of the cylindrical wall 46 from the opening 61. Accordingly, the second sealing part 85 interrupts communication between the first and second air channels 60 and 63 and the through-hole 71.

The second embodiment described above can obtain the same operational advantages described in the first embodiment.

3. Variations of the Second Embodiment

The third sealing part 287 that protrudes from the valve 278 is configured to be inserted into the through-hole 71 of the seal member 70 in the second embodiment described above. However, instead of the third sealing part 287 provided on the valve 278, a cylindrical seal part 88 may be provided on a seal member 70M in a variation of the second embodiment. Thus, a valve 78M of a valve element 77M of this variation is not provided with the third sealing part.

Figure 12:
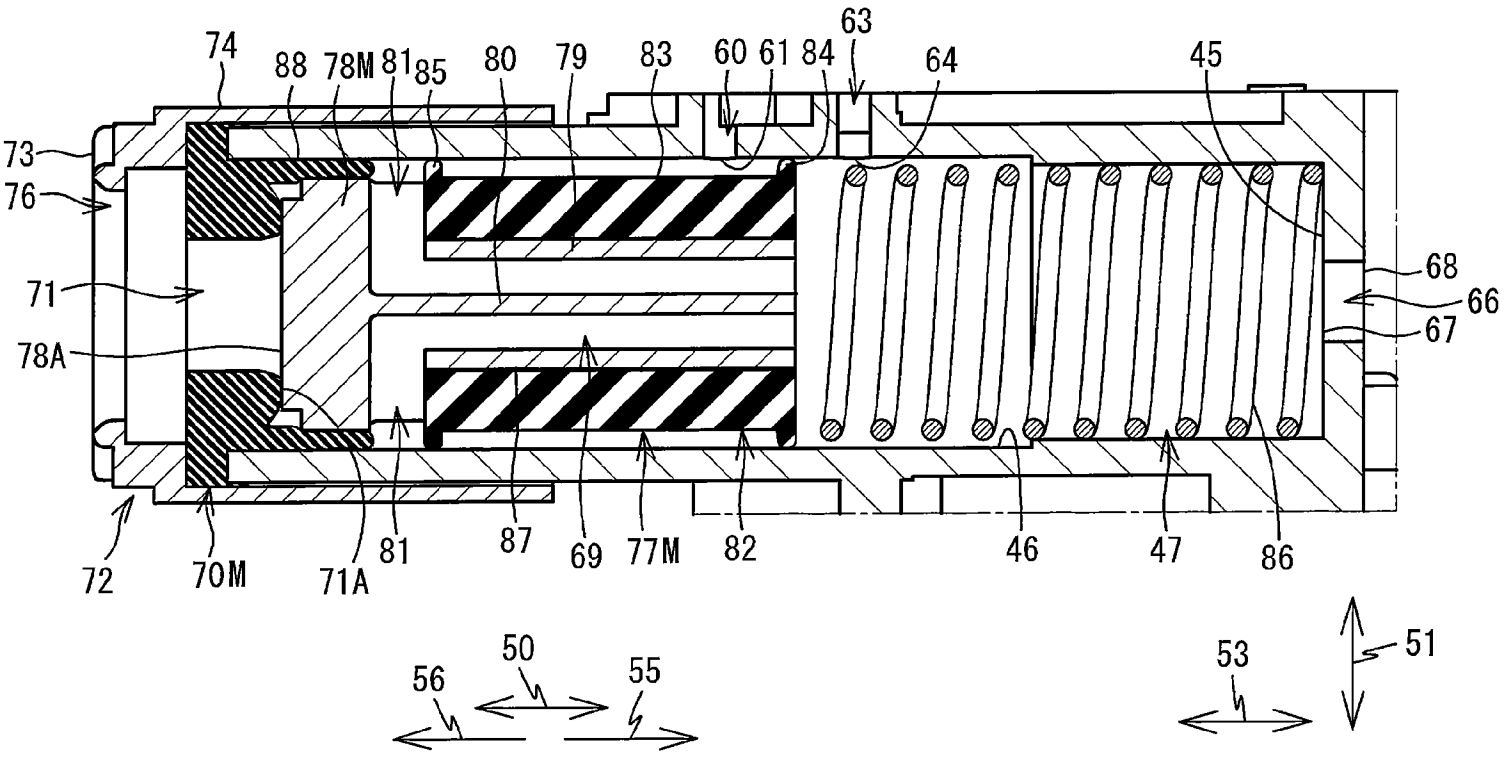
FIG. 12 is an enlarged cross-sectional view of the valve chamber in a horizontal cross section of an ink cartridge according to a variation of the second embodiment viewed from below when a valve element is in a first state.

Specifically, as shown in FIG. 12, the seal part 88 protrudes in the removing direction 55 from the peripheral edge of the seal member 70M at a position for contacting and forming a liquid-tight seal with the outer circumferential surface of the valve 78M. In other words, the outer circumferential surface of the valve 78M serves as the third sealing part. In this variation of the second embodiment, the dimension of the outer circumferential surface of the valve 78M in the mounting and removing directions 50 that contacts the seal part 88 when the valve element 77M is in the first state is greater than the distance in the mounting and removing directions 50 between the first sealing part 84 and opening 64 when the valve element 77M is in the first state, and smaller than the distance in the mounting and removing directions 50 between the second sealing part 85 and opening 61 when the valve element 77M is in the first state.

Still alternatively, while the seal member 70 is provided with the protruding part 71A in the second embodiment described above, the protruding part 71A may be omitted so that the front surface 278A of the valve 278 is separated from the seal member 70 when the valve element 277 is in the first state. In this case, the third sealing part 287 provided on the valve 278 is inserted into the through-hole 71 of the seal member 70 and closely contacts the same, thereby preventing ink from flowing out of the ink cartridge 30. However, since the seal member 70 in this variation has no contact surface that intersects the mounting direction 56 for receiving the biasing force of the coil spring 86, the coil spring 86 is in a state of near natural length when the valve 278 is in the first state. Consequently, the valve chamber 47 of this variation will be larger relative to the valve chamber 47 in the first and second embodiments.

4. Variations of the First and Second Embodiments

In the first and second embodiments described above, the third sealing part 287 or 105 is provided on only one of the valve 278 constituting the valve element 277 and ink needle 102, but a third sealing part may be provided on each of the valve 78(278) and ink needle 102(202). In this variation, the total length in the mounting and removing directions 50 of the third sealing parts provided on both the valve 78(278) and ink needle 102(202) is set to be greater than the length in the mounting and removing directions 50 between the first sealing part 84 and opening 64 when the valve element 77(277) is in the first state and smaller than the distance in the mounting and removing directions 50 between the second sealing part 85 and opening 61 when the valve element 77(277) is in the first state.

Further, the position for attaching the semipermeable membrane 44 is not limited to the position of the opening 62 in the embodiments described above, but may be any position along the first air channel 60. Further, it is possible to prevent ink from becoming deposited on the semipermeable membrane 44 and blocking the flow of air therethrough by providing a labyrinthian structure in an arbitrary position along the first air channel 60 between the opening 61 and semipermeable membrane 44.

Still further, while the inner peripheral surface of the cylindrical wall 46, the outer surface of the cylindrical part 83, and the outer surfaces of the first and second sealing parts 84 and 85 are circular in shape in a cross section taken orthogonal to the front-rear direction 53, the cross-sectional shape of these members is not limited to a circular shape, but may be an elliptical shape or rectangular shape, for example. Similarly, the cross-sectional shape of the outer peripheral surface of the cylindrical wall 46 and other components is not limited to a circular shape.

Further, the first and second sealing parts 84 and 85 may be configured of O-rings or the like that fit into circumferential grooves formed in the retaining part 79, for example.

Further, while the openings 61 and 64 are formed in the same position along the circumferential direction of the cylindrical wall 46 while being separated from each other in the front-rear direction 53, the positional relationship of these openings 61 and 64 is not limited to the example in the embodiments. For example, the openings 61 and 64 may be provided at the same position in the front-rear direction 53 while being separated along the circumference of the cylindrical wall 46 or may be provided at positions separated in both the front-rear direction 53 and the circumferential direction of the cylindrical wall 46. In such cases, the first sealing part 84 may be formed in any shape on the valve element 77(277) that can interrupt communication between the openings 61 and 64 (i.e., provided that the first sealing part 84 is annular and makes a loop around the entire circumferential surface of the cylindrical part 83).

For example, the first sealing part 84 may circumscribe the outer circumferential surface of the cylindrical part 83 along a plane that intersects the front-rear direction 53 (a plane orthogonal to the front-rear direction 53 in the embodiments described above). In other words, any tangent to the cylindrical part 83 that falls in this plane intersects the front-rear direction 53. The first sealing part 84 also need not be provided within a single plane, but may curve or meander around the cylindrical part 83. In such a case, a portion of the first sealing part 84 may extend in the front-rear direction 53. The same structural modifications may also be applied to the second sealing part 85. Further, one of the openings 61 and 64 may be formed in the proximal wall 45 rather than the cylindrical wall 46. Similarly, the opening 67 may be formed in the cylindrical wall 46 rather than the proximal wall 45.

The position of the valve chamber 47 is also not limited to the example in the embodiments described above. For example, the cylindrical wall 46 may protrude outward from the front surface of the front wall 40, in which case the front wall 40 also serves as the proximal wall 45. Further, the interior of a through-hole penetrating the front wall 40 in its thickness dimension may serve as the valve chamber 47, in which case the cylindrical wall 46 is omitted and the inner circumferential surface (peripheral surface) of the through-hole serves as the side wall surface.

Further, while the through-hole 71 formed in the seal member 70 has a smaller diameter than the outer diameter of the ink needle 102 or the third sealing part 287 of the valve 278 in the preferred embodiments, the present invention is not limited to this arrangement. That is, at least part of the through-hole 71 may be closed by the elasticity of the seal member 70 itself when the ink needle 102(202) is not inserted in the through-hole 71. With this configuration, the coil spring 86 need not be provided in the valve chamber 47. If the coil spring 86 is omitted from the valve chamber 47, then once the ink needle 102(202) has moved the valve element 77(277) into the third state, the valve element 77(277) will remain in the third state after the ink needle 102(202) is extracted from the valve chamber 47. Therefore, the valve 78(278) will not be in contact with the seal member 70, but the elasticity of the seal member 70 will at least partially close the through-hole 71, suppressing the outflow of ink from the valve chamber 47 through the through-hole 71.

5. Third Embodiment

A configuration according to a third embodiment of the present invention will be described next with reference to FIG. 13.

In the first embodiment described above, the ink cartridge 30 is mounted in the cartridge-mounting unit 110 in the horizontal direction. The third embodiment differs from the first embodiment in that an ink cartridge 32 is mounted vertically downward into the cartridge-mounting unit.

The cartridge-mounting unit of the third embodiment has a case (not shown) that is open on the top. The ink needle 102 protrudes upward from its inner back surface (i.e., bottom surface of the case). Hence, the upward direction in FIG. 13 corresponds to the removing direction 55, and the downward direction corresponds to the mounting direction 56. The structure of the ink needle 102 is identical to that in the first embodiment, other than its protruding direction. Hence, the third sealing part 105 is provided on the ink needle 102 between the distal end 103 and communication holes 104 in the third embodiment.

<Ink Cartridge 32>

Figure 13:
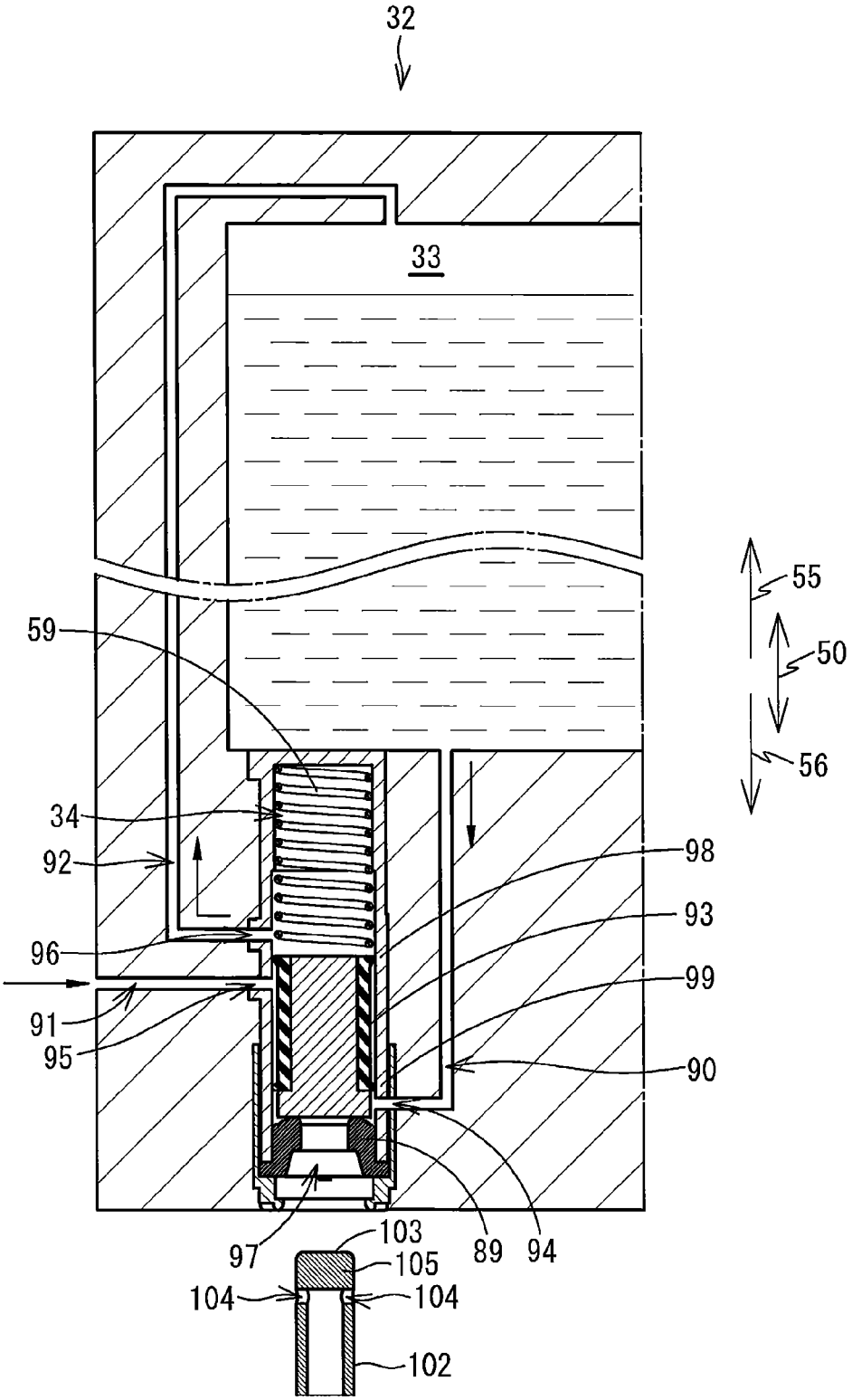
FIG. 13 is a vertical cross-sectional view schematically showing an ink cartridge according to a third embodiment.

As shown in FIG. 13, the ink cartridge 32 according to the third embodiment includes an ink chamber 33 and a valve chamber 34 defined therein. Ink stored in the ink chamber 33 is supplied externally through the valve chamber 34. The ink cartridge 32 is inserted in and extracted from the cartridge-mounting unit in the mounting and removing directions 50 while in the erected state shown in FIG. 13, i.e., while the bottom surface of the ink cartridge 32 in FIG. 13 is positioned on the bottom and the top surface in FIG. 13 is positioned on the top. That is, the mounting and removing directions 50 in the third embodiment are aligned with the vertical direction.

The valve chamber 34 is defined as a separate space from the ink chamber 33 and is disposed below the ink chamber 33. The valve chamber 34 is a cylindrical space defined by a side wall that extends vertically downward toward the exterior of the ink cartridge 32 away from the ink chamber 33 and that is annular in a horizontal cross section, and a proximal wall provided on the top end of the side wall. The valve chamber 34 is open in the bottom surface of the ink cartridge 32. The valve chamber 34 is connected to a liquid channel 90, a first air channel 91, and a second air channel 92. A seal member 89 is provided at the opening formed in the bottom of the valve chamber 34. A valve element 93 is accommodated in the valve chamber 34.

The liquid channel 90 allows ink to flow between a bottom end portion of the valve chamber 34 and the ink chamber 33. The liquid channel 90 provides communication between the valve chamber 34 and ink chamber 33 through an opening 94 formed in the side wall of the valve chamber 34 at its bottom end.

The first air channel 91 allows air to flow between the valve chamber 34 and the exterior of the ink cartridge 32. The first air channel 91 provides communication between the valve chamber 34 and the exterior of the ink cartridge 32 through an opening 95 formed in the side wall of the valve chamber 34. The opening 95 is provided at a position higher than the opening 94.

The second air channel 92 allows air to flow between the valve chamber 34 and ink chamber 33. The second air channel 92 provides communication between the valve chamber 34 and a space in the ink chamber 33 above the level of ink stored therein through an opening 96 formed in the side wall of the valve chamber 34. The opening 96 is disposed above the opening 95.

The seal member 89 has a disc-like shape and has an outer diameter substantially equivalent to the inner diameter of the valve chamber 34. The seal member 89 is mounted in the opening formed at the bottom of the valve chamber 34 and forms a liquid-tight seal with an inner circumferential edge defining the opening. A through-hole 97 is formed in the seal member 89 to penetrate a center region of the seal member 89 in its thickness dimension (vertically). The through-hole 97 provides communication between interior and exterior of the valve chamber 34.

The valve element 93 has a cylindrical shape that forms a close contact with an upper surface of the seal member 89 around the through-hole 97 (peripheral edge of the through-hole 97). The valve element 93 has a first sealing part 98 and a second sealing part 99 that are flange-like in shape and protrude radially outward from the outer surface of the valve element 93. The first and second sealing parts 98 and 99 slide along the inner surface of the side wall of the valve chamber 34 when the valve element 93 moves vertically within the valve chamber 34. The first and second sealing parts 98 and 99 contact and form an airtight seal with the side wall of the valve chamber 34 and define an enclosed space therebetween. Air can circulate within the enclosed space between the first and second sealing parts 98 and 99.

A coil spring 59 is disposed between the proximal wall of the valve chamber 34 and the valve element 93. The coil spring 59 urges the valve element 93 toward the seal member 89 for maintaining the valve element 93 in a first state within the valve chamber 34 for contacting the seal member 89.

Prior to mounting the ink cartridge 32 in the cartridge-mounting unit, the valve element 93 is in the first state in contact with the seal member 89, as shown in FIG. 13. When in this first state, the valve element 93 contacts and forms a liquid-tight seal with the seal member 89 at the peripheral edge of the through-hole 97, thereby blocking the through-hole 97. The opening 94 of the liquid channel 90 is positioned below the second sealing part 99, and specifically near the bottom end of the side wall. Thus, the ink chamber 33 and valve chamber 34 are in communication with each other through the liquid channel 90, but the through-hole 97 is closed by the valve element 93 in the valve chamber 34, preventing ink from flowing out of the valve chamber 34.

At this time, the first sealing part 98 is positioned between the openings 95 and 96, thereby interrupting communication between the first and second air channels 91 and 92. The second sealing part 99 contacts and forms an airtight seal with the side wall of the valve chamber 34 beneath the opening 95, thereby interrupting communication between the first air channel 91 and through-hole 97.

As in the first embodiment described above, the valve element 93 moves upward from the first state to the second state as the ink cartridge 32 is being inserted into the cartridge-mounting unit 110 because the ink needle 102 inserted into the valve chamber 34 through the through-hole 97 presses against the valve element 93.

When the valve element 93 is in the second state, the valve element 93 is separated from the through-hole 97 formed in the seal member 89, but the through-hole 97 is still sealed since the third sealing part 105 of the ink needle 102 is inserted in the through-hole 97. Therefore, the valve chamber 34 is not yet in communication with the internal space of the ink needle 102.

When the valve element 93 is in the second state, the first sealing part 98 is positioned above the opening 96, and the second sealing part 99 is positioned below the opening 95 but above the opening 94. Thus communication between the first air channel 91 and second air channel 92 is permitted while communication between the first and second air channels 91 and 92 and the liquid channel 90 is interrupted. Hence, the ink chamber 33 is in communication with the external air through the first air channel 91, the enclosed space between the first and second sealing parts 98 and 99 (the valve chamber 34), and the second air channel 92.

Once the ink cartridge 32 is completely mounted in the cartridge-mounting unit 110 (when ink can be supplied from the ink cartridge 32), the valve element 93 is in the third state higher than the second state due to pressure from the ink needle 102 inserted further into the valve chamber 34.

In this third state, the valve element 93 is separated from the seal member 89, and the third sealing part 105 has completely passed through the through-hole 97 formed in the seal member 89. As the ink needle 102 is further inserted through the through-hole 97 of the seal member 89, the communication holes 104 of the ink needle 102 also advance through the through-hole 97 into the valve chamber 34. As a result, the liquid channel 90 is in communication with the liquid channel (internal space) formed inside the ink needle 102 through the valve chamber 34 and the through-hole 97, and ink in the ink chamber 33 can flow out of the ink cartridge 32.

The third embodiment described above can obtain the same operational advantages described in the first embodiment.

6. Variation of the Third Embodiment

Next, a variation of the third embodiment will be described with reference to FIG. 14. While the opening 96 is provided in the side wall of the valve chamber 34 in the third embodiment, an opening 96M is formed in a proximal wall 35 of the valve chamber 34 to form a second air channel 92M between the ink chamber 33 and valve chamber 34 in the variation of the third embodiment.

Further, in addition to the first and second sealing parts 98 and 99, a valve element 93M is provided with a fourth sealing part 48M. The fourth sealing part 48M is also a flange-like member and is disposed closer to the proximal wall 35 than the first and second sealing parts 98 and 99 are to the proximal wall 35.

A through-hole 49M is also formed in the valve element 93M for providing communication between the space of the valve chamber 34 between the first and second sealing parts 98 and 99 and the space of the valve chamber 34 on the proximal wall 35 side of the fourth sealing part 48M. The through-hole 49M extends between an opening 57M formed in the circumferential wall of the valve element 93M, and an opening 58M formed in the endface of the valve element 93M facing the proximal wall 35.

Figure 14:
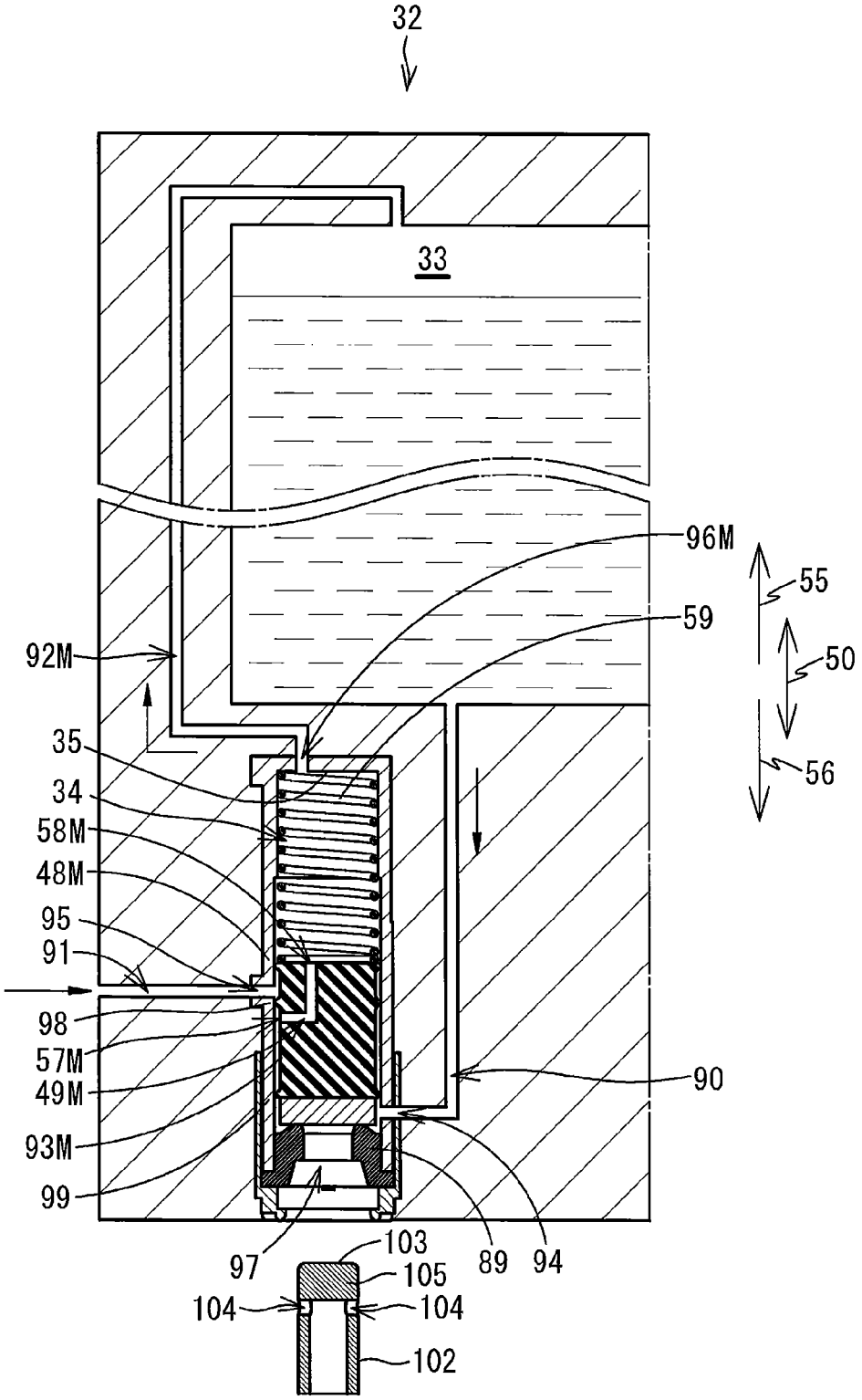
FIG. 14 is a vertical cross-sectional view schematically showing an ink cartridge according to a variation of the third embodiment.

Prior to the ink cartridge 32 being mounted in the cartridge-mounting unit, the valve element 93M is in a first state for contacting the seal member 89, as shown in FIG. 14. While in this first state, the valve element 93M contacts and forms a liquid-tight seal with the seal member 89 on the periphery of the through-hole 97, thereby blocking the through-hole 97. Although the ink chamber 33 and valve chamber 34 can communicate through the liquid channel 90, ink cannot flow out of the valve chamber 34 because the valve element 93M is blocking the through-hole 97 in the valve chamber 34.

At this time, the first sealing part 98 is positioned between the openings 57M and 95, thereby interrupting communication between the first air channel 91 and through-hole 49M and, hence, interrupting communication between the first air channel 91 and second air channel 92M. The second sealing part 99 contacts and forms an airtight seal with the side wall of the valve chamber 34 at a position below the opening 95, thereby interrupting communication between the first air channel 91 and through-hole 97. The fourth sealing part 48M contacts and forms an airtight seal with the side wall of the valve chamber 34 at a position between the openings 95 and 96M, thereby interrupting communication between the openings 95 and 96M.

As in the first embodiment described above, the valve element 93M moves upward from the first state into the second state as the ink cartridge 32 is being mounted in the cartridge-mounting unit because the ink needle 102 inserted into the valve chamber 34 through the through-hole 97 presses against the valve element 93M.

When in the second state, the valve element 93M is separated from the through-hole 97 of the seal member 89. However, the through-hole 97 is still sealed since the third sealing part 105 of the ink needle 102 is inserted into the through-hole 97. Hence, the valve chamber 34 is not in communication with the internal space of the ink needle 102.

When the valve element 93M is in the second state, the first sealing part 98 is positioned above the opening 95, while the second sealing part 99 is positioned below the opening 95. Accordingly, the openings 57M and 95 are positioned in the space between the first and second sealing parts 98 and 99, allowing for communication between the first air channel 91 and through-hole 49M and, hence, communication between the first and second air channels 91 and 92M. Further, communication is interrupted between both of the first air channel 91 and through-hole 49M and the liquid channel 90. Accordingly, the ink chamber 33 communicates with the external air through the first air channel 91, the enclosed space between the first and second sealing parts 98 and 99 (the valve chamber 34), the through-hole 49M, a portion of the valve chamber 34 above the valve element 93M, and the second air channel 92M. The fourth sealing part 48M contacts and forms an airtight seal with the side wall of the valve chamber 34 at a position between the openings 95 and 96M, thereby interrupting communication between the openings 95 and 96M.

Once the ink cartridge 32 is completely mounted in the cartridge-mounting unit (when ink can be supplied from the ink cartridge 32), the valve element 93M is in the third state at a position above the second state due to pressure from the ink needle 102 inserted further into the valve chamber 34.

When in the third state, the valve element 93M is separated from the seal member 89, and the third sealing part 105 has completely passed through the through-hole 97 formed in the seal member 89. As the ink needle 102 is inserted further through the through-hole 97 of the seal member 89, the communication holes 104 pass through the through-hole 97 and advance into the valve chamber 34. As a result, the liquid channel 90 can communicate with the liquid channel formed inside the ink needle 102 through the valve chamber 34 and through-hole 97, enabling ink in the ink chamber 33 to flow out of the ink cartridge 32.

The variation of the third embodiment described above can obtain the same operational advantages described in the third embodiment.

While the invention has been described in detail with reference to the specific embodiment thereof, it would be apparent to those skilled in the art that various changes and modifications may be made therein without departing from the scope of the invention.

What is claimed is:

1. A liquid supplying device comprising:

a liquid cartridge; and a cartridge mounting unit configured to detachably accommodate the liquid cartridge therein, the cartridge mounting unit including a liquid extraction tube configured to be inserted into the liquid cartridge during mounting and in a mounted state of the liquid cartridge in the cartridge mounting unit, the liquid extraction tube defining an internal space therein and including a communication hole configured to allow communication between the internal space and outside of the liquid extraction tube, the liquid cartridge comprising:

a liquid chamber configured to store liquid therein;

a valve chamber extending in a first direction away from the liquid chamber, the valve chamber being defined by a wall surface including a side wall surface and a proximal wall surface, the side wall surface extending in the first direction and having an annular shaped cross-section taken along a plane orthogonal to the first direction, the side wall surface having a first end and a second end positioned downstream of the first end in the first direction, the proximal wall surface provided on the first end of the side wall surface, the wall surface being formed with a first opening and a second opening, at least one of the first opening and the second opening being formed in the side wall surface;

a first air channel configured to allow air to flow between the valve chamber and ambient air through the first opening;

a second air channel configured to allow air to flow between the liquid chamber and the valve chamber through the second opening;

a seal member provided on the second end of the side wall surface, the seal member being formed with a through-hole for allowing the liquid extraction tube to penetrate therethrough in a second direction opposite to the first direction, the through-hole being defined by a peripheral surface;

a valve element disposed within the valve chamber and having an outer surface, the valve element including a closing part configured to contact the seal member to close the through-hole, at least one of the closing part of the valve element and the liquid extraction tube being provided with a third sealing part configured to make close contact with the peripheral surface of the through-hole and slide relative to the peripheral surface;

a first sealing part having an annular shape and provided on the outer surface of the valve element, the first sealing part being in close contact with the side wall surface and configured to move in the second direction;

a second sealing part having an annular shape and provided on the outer surface of the valve element at a position toward the second end of the side wall surface from the first sealing part, the second sealing part being in close contact with the side wall surface and configured to move in the second direction, the first sealing part and the second sealing part defining an enclosed space therebetween in the valve chamber; and a liquid channel configured to allow liquid to flow between the liquid chamber and a portion of the valve chamber toward the second end of the side wall surface from the second sealing part, wherein the liquid extraction tube is configured to enter into the valve chamber through the through-hole of the seal member in the second direction and contact the closing part to move the valve element in the second direction from a first state to a second state and then to a third state, the third sealing part being positioned downstream of the communication hole of the liquid extraction tube inserted into the valve chamber in the second direction, wherein:

in the first state, the closing part closes the through-hole of the seal member, the first sealing part interrupting air flow between the first opening and the second opening and the second sealing part being positioned toward the second end of the side wall surface from the first opening and the second opening;

in the second state, the liquid extraction tube penetrates through the through-hole and contacts the closing part to move the closing part in the second direction away from the through-hole, the third sealing part making close contact with the peripheral surface of the through-hole to seal the communication hole, air being allowed to flow between the first opening and the second opening through the enclosed space; and in the third state, the third sealing part is separated from the peripheral surface of the through-hole, the communication hole of the liquid extraction tube entering into the valve chamber to realize communication between the valve chamber and the internal space of the liquid extraction tube.

2. The liquid supplying device as claimed in claim 1, further comprising a biasing member disposed within the valve chamber between the valve element and the proximal wall surface, the biasing member being configured to bias the valve element in the first direction, wherein the valve element is configured to move in the first direction and in the second direction within the valve chamber.

3. The liquid supplying device as claimed in claim 2, wherein the seal member includes a contact surface intersecting the first direction, and wherein the closing part is in contact with the contact surface of the seal member biased in the first direction to maintain the valve element in the first state.

4. The liquid supplying device as claimed in claim 1, wherein, in the first state, the first sealing part is positioned between the first opening and the second opening to interrupt air flow between the first opening and the second opening.

5. The liquid supplying device as claimed in claim 1, wherein both of the first opening and the second opening are formed in the side wall surface constituting the valve chamber.

6. The liquid supplying device as claimed in claim 1, wherein the liquid channel comprises:

a first liquid channel configured to allow liquid to flow between the valve chamber and the liquid chamber through a third opening formed in the valve chamber near the first end of the side wall surface; and a second liquid channel penetrating the valve element, the second liquid channel connecting between a fourth opening and a fifth opening, the fourth opening being open on the valve element toward the first end of the side wall surface and the fifth opening being open on the valve element toward the second end of the side wall surface.

7. The liquid supplying device as claimed in claim 6, wherein the third opening is formed in the proximal wall surface.

8. The liquid supplying device as claimed in claim 1, wherein the side wall surface and the outer surface of the valve element have a circular shape in cross-section taken along a plane orthogonal to the first direction, and wherein the first sealing part and the second sealing part have a flange-like shape that protrudes radially outward from the outer surface of the valve element and that is formed continuously in a circumferential direction of the valve element.

9. A liquid cartridge comprising:

a liquid chamber configured to store liquid therein;

a valve chamber extending in a first direction away from the liquid chamber, the valve chamber being defined by a wall surface including a side wall surface and a proximal wall surface, the side wall surface extending in the first direction and having an annular shaped cross-section taken along a plane orthogonal to the first direction, the side wall surface having a first end and a second end positioned downstream of the first end in the first direction, the proximal wall surface provided on the first end of the side wall surface, the wall surface being formed with a first opening and a second opening, at least one of the first opening and the second opening being formed in the side wall surface;

a first air channel configured to allow air to flow between the valve chamber and ambient air through the first opening;

a second air channel configured to allow air to flow between the liquid chamber and the valve chamber through the second opening;

a seal member provided on the second end of the side wall surface, the seal member being formed with a through-hole defined by a peripheral surface;

a valve element disposed within the valve chamber and including a closing part configured to contact the seal member to close the through-hole, the valve element having an outer surface;

a first sealing part having an annular shape and provided on the outer surface of the valve element, the first sealing part being in close contact with the side wall surface and configured to move in a second direction opposite to the first direction;

a second sealing part having an annular shape and provided on the outer surface of the valve element at a position toward the second end of the side wall surface from the first sealing part, the second sealing part being in close contact with the side wall surface and configured to move in the second direction, the first sealing part and the second sealing part defining an enclosed space therebetween in the valve chamber;

a third sealing part provided on the closing part and configured to make close contact with the peripheral surface of the through-hole and slide relative to the peripheral surface; and a liquid channel configured to allow liquid to flow between the liquid chamber and a portion of the valve chamber toward the second end of the side wall surface from the second sealing part, wherein the valve element is configured to move in the second direction from a first state to a second state and then to a third state, wherein:

in the first state, the closing part closes the through-hole of the seal member, the first sealing part interrupting air flow between the first opening and the second opening and the second sealing part being positioned toward the second end of the side wall surface from the first opening and the second opening;

in the second state, the third sealing part makes close contact with the peripheral surface of the through-hole, air being allowed to flow between the first opening and the second opening through the enclosed space; and in the third state, the third sealing part is separated from the peripheral surface of the through-hole and the liquid channel is in communication with outside of the valve chamber.

* * * * *